US010214944B2

(12) United States Patent
Hanaki et al.

(10) Patent No.: US 10,214,944 B2
(45) Date of Patent: Feb. 26, 2019

(54) OPENING-AND-CLOSING DEVICE FOR VEHICLE DOOR

(71) Applicant: MITSUI KINZOKU ACT CORPORATION, Kanagawa (JP)

(72) Inventors: Naoki Hanaki, Kanagawa (JP); Kohei Yamashita, Kanagawa (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 857 days.

(21) Appl. No.: 14/794,624

(22) Filed: Jul. 8, 2015

(65) Prior Publication Data

US 2016/0010365 A1 Jan. 14, 2016

(30) Foreign Application Priority Data

Jul. 10, 2014 (JP) ..... 2014-142220

(51) Int. Cl.

| | |
|---|---|
| ***E05B 79/20*** | (2014.01) |
| ***E05B 81/14*** | (2014.01) |
| ***E05B 81/54*** | (2014.01) |
| ***E05B 81/90*** | (2014.01) |
| *E05B 81/06* | (2014.01) |
| *E05B 81/38* | (2014.01) |
| *E05B 83/40* | (2014.01) |

(52) U.S. Cl.

CPC ..... *E05B 79/20* (2013.01); *E05B 81/14* (2013.01); *E05B 81/54* (2013.01); *E05B 81/90* (2013.01); *E05B 81/06* (2013.01); *E05B 81/38* (2013.01); *E05B 83/40* (2013.01); *Y10S 292/46* (2013.01)

(58) Field of Classification Search

CPC ..... Y10S 292/46

USPC ..... 292/201; 296/155

See application file for complete search history.

(56) References Cited

U.S. PATENT DOCUMENTS 5,534,846 A * 7/1996 Kuroda ..... E05B 77/48 180/287

5,893,593 A * 4/1999 Dowling ..... E05B 77/26 292/169.11

(Continued)

FOREIGN PATENT DOCUMENTS

JP 60092925 A * 5/1985 ..... B60J 5/06

JP 02124318 A * 5/1990

(Continued)

OTHER PUBLICATIONS

Decision to Grant issued in corresponding Japanese Patent Application No. 2014-142220, dated Mar. 6, 2018.

*Primary Examiner* — Carlos Lugo

(74) *Attorney, Agent, or Firm* — McDermott Will & Emery LLP

(57) ABSTRACT

An opening-and-closing device for vehicle door includes: a close-latch mechanism which holds a door at a closed position; an open-latch mechanism which holds the door at an opened position; an electric-powered releasing mechanism which operates the close-latch mechanism; an open-latch interlocking mechanism which operates from an initial position toward a canceling direction in conjunction with an operation of the open-latch mechanism from an unlatched position to a latched position; and a relay mechanism which changes a state of a transmission path of releasing operation from a connected state to a disconnected state to allow returning of a first ratchet which has stopped in a releasing position.

2 Claims, 17 Drawing Sheets

(56) References Cited

U.S. PATENT DOCUMENTS

| | | | | | |
|---|---|---|---|---|---|
| 5,979,971 | A * | 11/1999 | Mizuki | E05B 65/0811 | 292/219 |
| 6,135,513 | A * | 10/2000 | Hamada | E05B 77/26 | 292/201 |
| 6,412,222 | B1 * | 7/2002 | Hashiba | B60J 5/06 | 296/155 |
| 7,288,907 | B2 * | 10/2007 | Kamiya | B60J 5/06 | 296/146.2 |
| 7,472,944 | B2 * | 1/2009 | Miyagawa | B60J 5/06 | 296/155 |
| 7,591,493 | B2 * | 9/2009 | Nozawa | E05B 77/265 | 292/201 |
| 8,245,447 | B2 * | 8/2012 | Oh | E05C 17/60 | 296/155 |
| 8,333,414 | B2 * | 12/2012 | Takayanagi | E05B 81/14 | 292/201 |
| 8,533,998 | B2 * | 9/2013 | Nishikibe | E05B 81/14 | 49/280 |
| 8,894,103 | B2 * | 11/2014 | Shibayama | E05B 83/40 | 292/201 |
| 8,967,680 | B2 * | 3/2015 | Yokomori | B60J 5/00 | 292/201 |
| 2005/0280265 | A1 | 12/2005 | Iliescu et al. | | |
| 2008/0012355 | A1 * | 1/2008 | Fujimatsu | E05B 83/36 | 292/216 |

FOREIGN PATENT DOCUMENTS

| | | | |
|---|---|---|---|
| JP | 2005-213818 | A | 8/2005 |
| JP | 4428047 | B2 | 3/2010 |
| JP | 2014-047548 | | 3/2014 |
| JP | 2014-074324 | | 4/2014 |

* cited by examiner

OPENING-AND-CLOSING DEVICE FOR VEHICLE DOOR

CROSS-REFERENCE TO RELATED APPLICATION(S)

The present application claims priority to and incorporates by reference the entire contents of Japanese Patent Application No. 2014-142220 filed in Japan on Jul. 10, 2014.

BACKGROUND OF THE INVENTION

1. Field of the Invention

The present invention relates to an opening-and-closing device for vehicle door that can release a close-latch mechanism for locking a vehicle door with an electric-powered releasing mechanism.

2. Description of the Related Art

Conventionally, an opening-and-closing device for vehicle door is used that has a latch mechanism (close-latch mechanism) including a latch configured to engage with a striker to hold a door in a closed position and a ratchet configured to engage with the latch, and an electric-powered releasing mechanism mechanically coupled to the ratchet and including a driving source such as a motor.

In such configuration, when an electrical trouble, such as a malfunction or stick of the motor, occurs when the electric-powered releasing mechanism is performing a releasing operation to cancel the engagement in the close-latch mechanism, the ratchet might be locked in the position of the releasing operation (this state is hereinafter referred to as a "locked-in-release state"). In the locked-in-release state, the ratchet cannot further pivot to engage with the latch to hold the door in the closed position.

To handle such trouble, a configuration is provided that can cancel the locked-in-release state by inserting a tool in a tool-hole opened to the room in a vehicle or by manually operating a knob provided in the room (for example, see Japanese Patent No. 4428047 or Japanese Patent Application Laid-open No. 2005-213818).

In the aforementioned related art, a special procedure is required to manually cancel the locked-in-release state. This requires a user to previously know the procedure to cancel the locked-in-release state. A user who does not know the procedure have to look into a vehicle manual or make a search to find a procedure, and hence the door cannot be closed immediately.

SUMMARY OF THE INVENTION

It is an object of the present invention to at least partially solve the problems in the conventional technology.

According to one aspect of the present invention, there is provided an opening-and-closing device for vehicle door including: a close-latch mechanism that is provided to a door, the close-latch mechanism including a first latch configured to move from an unlatched position to a latched position and a first ratchet configured to engage with the first latch in the latched position to hold the door in a closed position; an open-latch mechanism that is provided to the door, the open-latch mechanism including a second latch configured to move from an unlatched position to a latched position and a second ratchet configured to engage with the second latch in the latched position to hold the door in an opened position; an electric-powered releasing mechanism that is configured to operate the first ratchet to a releasing position; an open-latch interlocking mechanism that is configured to operate from an initial position toward a canceling direction in conjunction with a motion of the second latch from the unlatched position to the latched position; and a relay mechanism that is configured to change a state of a transmission path of releasing operation from a connected state to a disconnected state to allow returning of the first ratchet which has stopped in the releasing position, a releasing operation of the electric-powered releasing mechanism being transmitted to the first ratchet in the connected state and not being transmitted to the first ratchet in the disconnected state, the connected state changing to the disconnected state by the open-latch interlocking mechanism operating toward the canceling direction.

According to the configuration, the locked-in-release state can be canceled by a normal procedure of simply opening the door. When the locked-in-release state occurs, a user can keep the door in the closed position without a special procedure.

The open-latch interlocking mechanism according to another aspect of the present invention includes a cam lever configured to pivot by making contact with the second latch pivoting from the unlatched position to the latched position, a cancel lever coupled to the relay mechanism via a cable and configured to pivot integrally with the cam lever, and an urging member configured to urge the cam lever and the cancel lever, which have pivoted by making contact with the second latch, to return to initial positions, and the relay mechanism can be changed from the connected state to the disconnected state with the cable pulled by pivoting of the cancel lever.

The open-latch mechanism of the whole open-latch device and the open-latch interlocking mechanism can easily operate in conjunction with each other, with the open-latch mechanism operating to change the state of the relay mechanism to a disconnected state.

The malfunction causing the locked-in-release state is thereby eliminated and the disconnecting lever can smoothly return to the initial position.

The relay mechanism according to still another aspect of the present invention includes a relay lever configured to pivot by the releasing operation of the electric-powered releasing mechanism, a transmission lever configured to pivot in conjunction with the relay lever to transmit the releasing operation to the first ratchet, a disconnecting lever configured to pivot, with the cable pulled by pivoting of the cancel lever, to cancel interlock between the relay lever and the transmission lever, and a floating pin movably inserted through a hole provided in the relay lever, a hole provided in the transmission lever, and a hole provided in the disconnecting lever, and the hole in the transmission lever has an inclined portion against which the floating pin slides thereby allowing the disconnecting lever to return to an initial position, when the relay lever returns to the initial position after the interlock between the relay lever and the transmission lever is canceled by pivoting of the disconnecting lever.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Now, an opening-and-closing device for vehicle door according to a preferable embodiment of the present invention will be described in detail referring to attached drawings.

Figure 1:
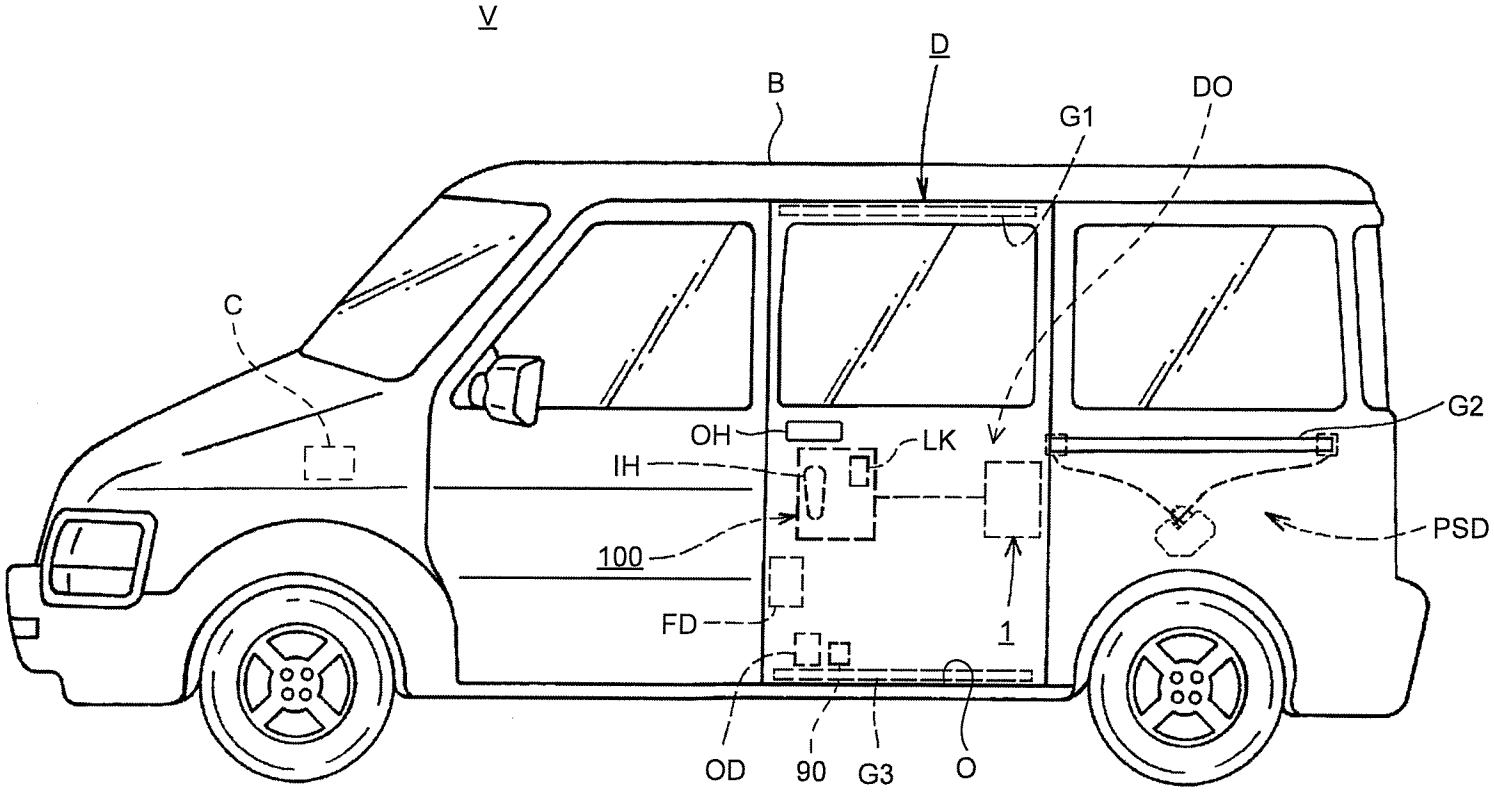
FIG. 1 is a side view of a vehicle including an opening-and-closing device for vehicle door according to one embodiment of the present invention.

1. Explanation on Overall Configuration of Opening-and-Closing Device for Vehicle Door FIG. 1 is a side view of a vehicle V including an opening-and-closing device for vehicle door DO according to one embodiment of the present invention. As illustrated in FIG. 1, the vehicle V includes a door D that opens and closes a door opening O in the side face of a vehicle body B. The door D is a sliding door supported by an upper guide rail G1, a waist guide rail G2, and a lower guide rail G3, which are fixed to the vehicle body B, so as to slide in the front-and-rear direction to open and close. An electric open/close unit PSD which opens and closes the door D with electric power is provided on the inner side of the side face of the vehicle body B.

An outside handle OH is provided on the outer side of the door D to be used for opening and closing the door D from outside the vehicle. An inside handle IH used for opening and closing the door D from the inside of the vehicle and a lock-manipulating knob LK used for manually unlocking and locking an operation-relaying device 100 are provided on the inner side of the door D. A front door latching device FD which holds the door D at a closed position is provided in the front side of the door D. A whole open-latch device OD which holds the door D at a full-opened position and an open-latch interlocking mechanism 90 which performs the release-canceling operation to release a locked-in-release state, which will be described later, are provided in the lower portion of the door D. A rear door latching device 1 which operates in conjunction with the front door latching device FD to hold the door D at the closed position is provided in the rear portion of the door D.

The operation-relaying device 100 is provided inside the door D. The operation-relaying device 100 relays operation manually given through the outside handle OH and the inside handle IH and electric operation given by a releasing drive of a motor 32 (see FIG. 2). The operation-relaying device 100 relays the control-operation to the rear door latching device 1, the front door latching device FD, and the whole open-latch device OD.

2. Explanation on Rear Door Latching Device

Figure 2:
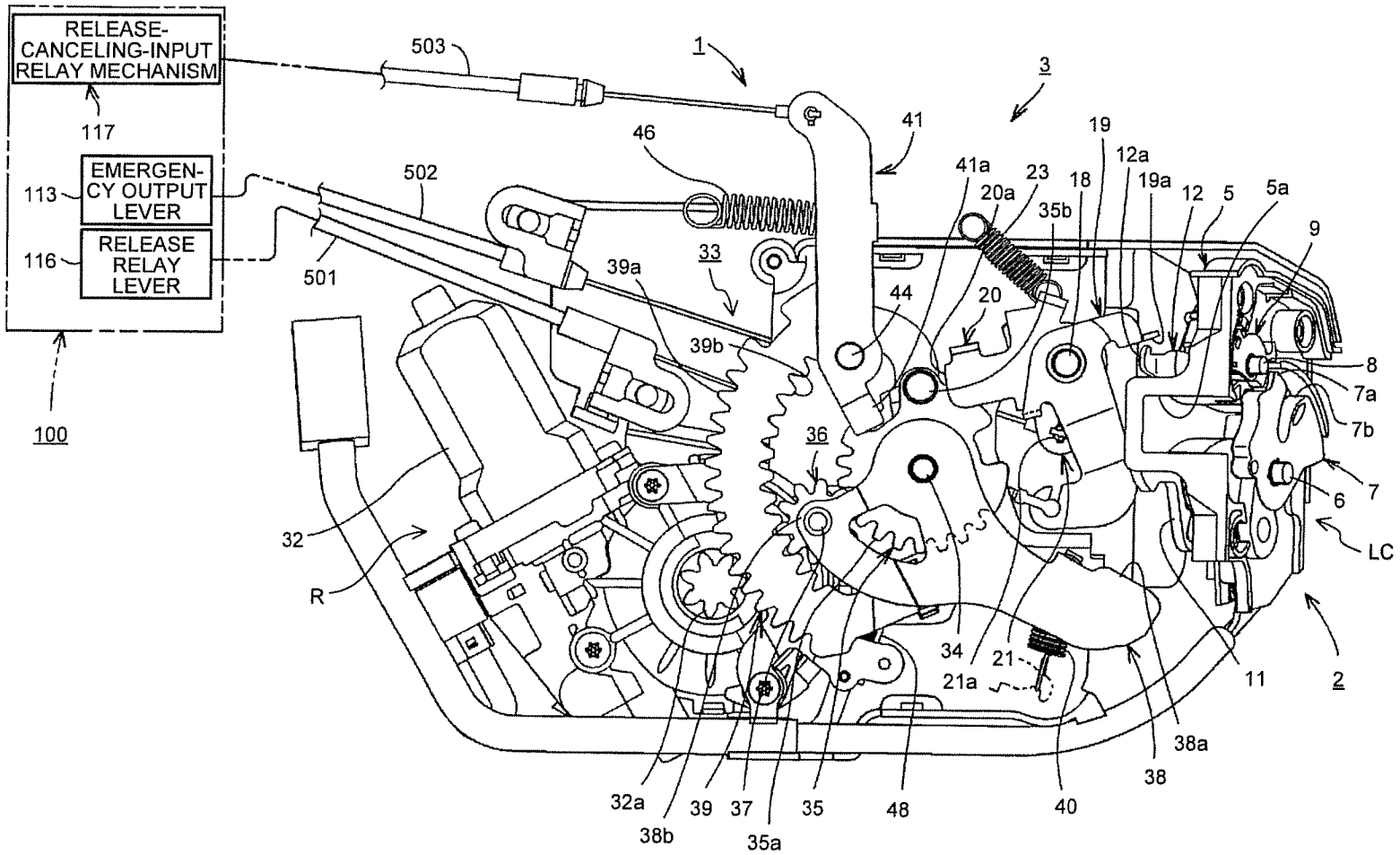
FIG. 2 is a side view of a rear door latching device viewed from the inside of a vehicle.

FIG. 2 is a side view of the rear door latching device 1 viewed from the inside of the vehicle. As illustrated in FIG. 2, the rear door latching device 1 includes a latch unit 2 and a closer release unit 3. The latch unit 2 is a mechanism that engages with a striker S1 (see FIG. 4) provided in the vehicle body B and that holds the door D at the closed position. The closer release unit 3 closes and releases the door D.

2.1 Explanation on Latch Unit

Figure 3:
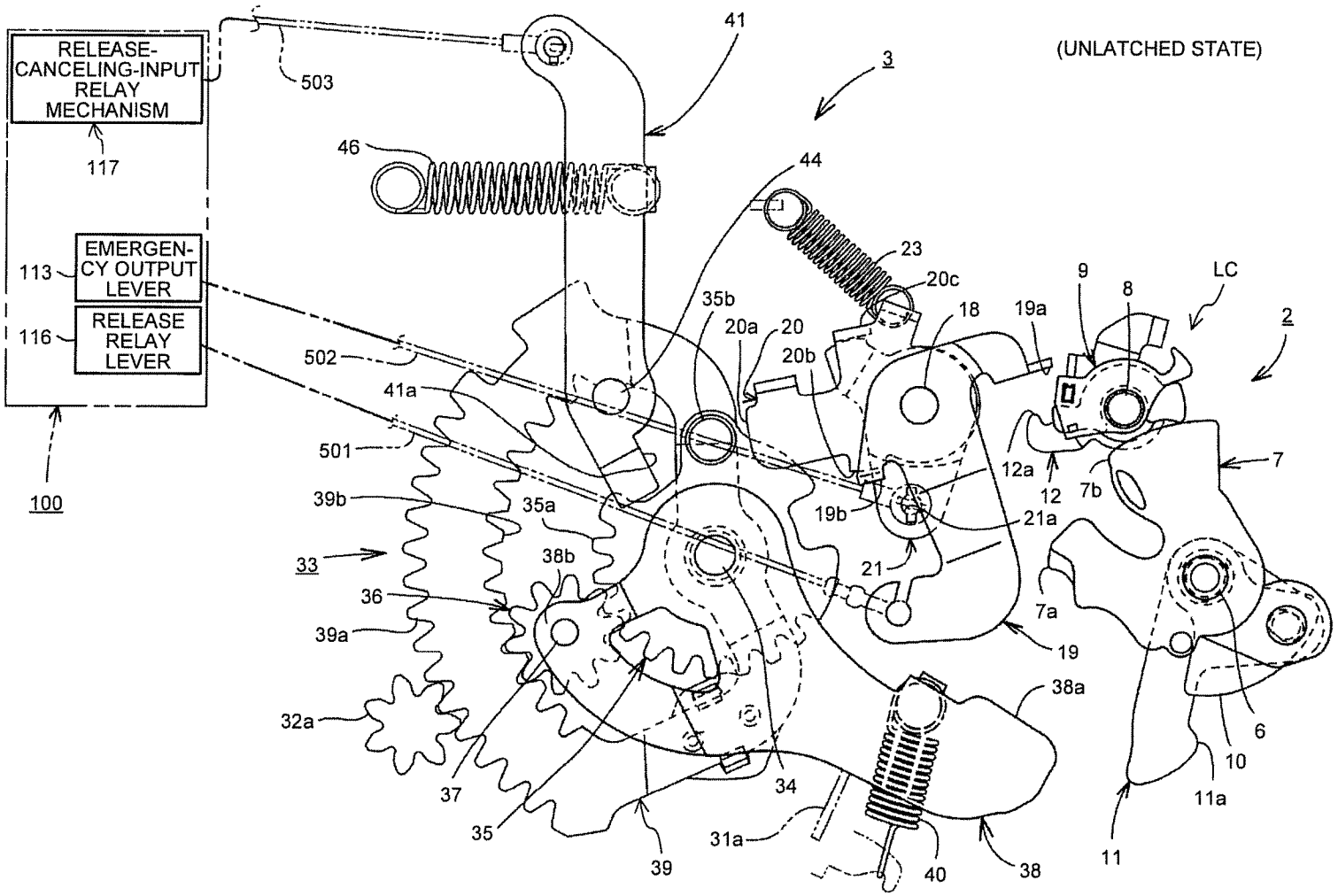
FIG. 3 is an explanatory drawing illustrating an unlatched state of the rear door latching device.

As illustrated in FIGS. 2 and 3, the latch unit 2 contains, in a housing 5 mounted on the door D, a close-latch mechanism LC including a latch (first latch) 7 and a ratchet (first ratchet) 9. The latch 7 is pivotally supported by a latch shaft 6, extending in the front-and-rear direction, and can engage with a striker S1 when the door D is closed. The ratchet 9 is pivotally supported by a ratchet shaft 8, extending in the front-and-rear direction, and can selectively engage with a full-latch engagement portion 7*a* or a half-latch engagement portion 7*b* provided on the outer periphery of the latch 7. An opening of the housing 5 containing the close-latch mechanism LC is covered with a cover plate (not illustrated). The latch unit 2 is mounted on the door D via the cover plate.

Figure 4:
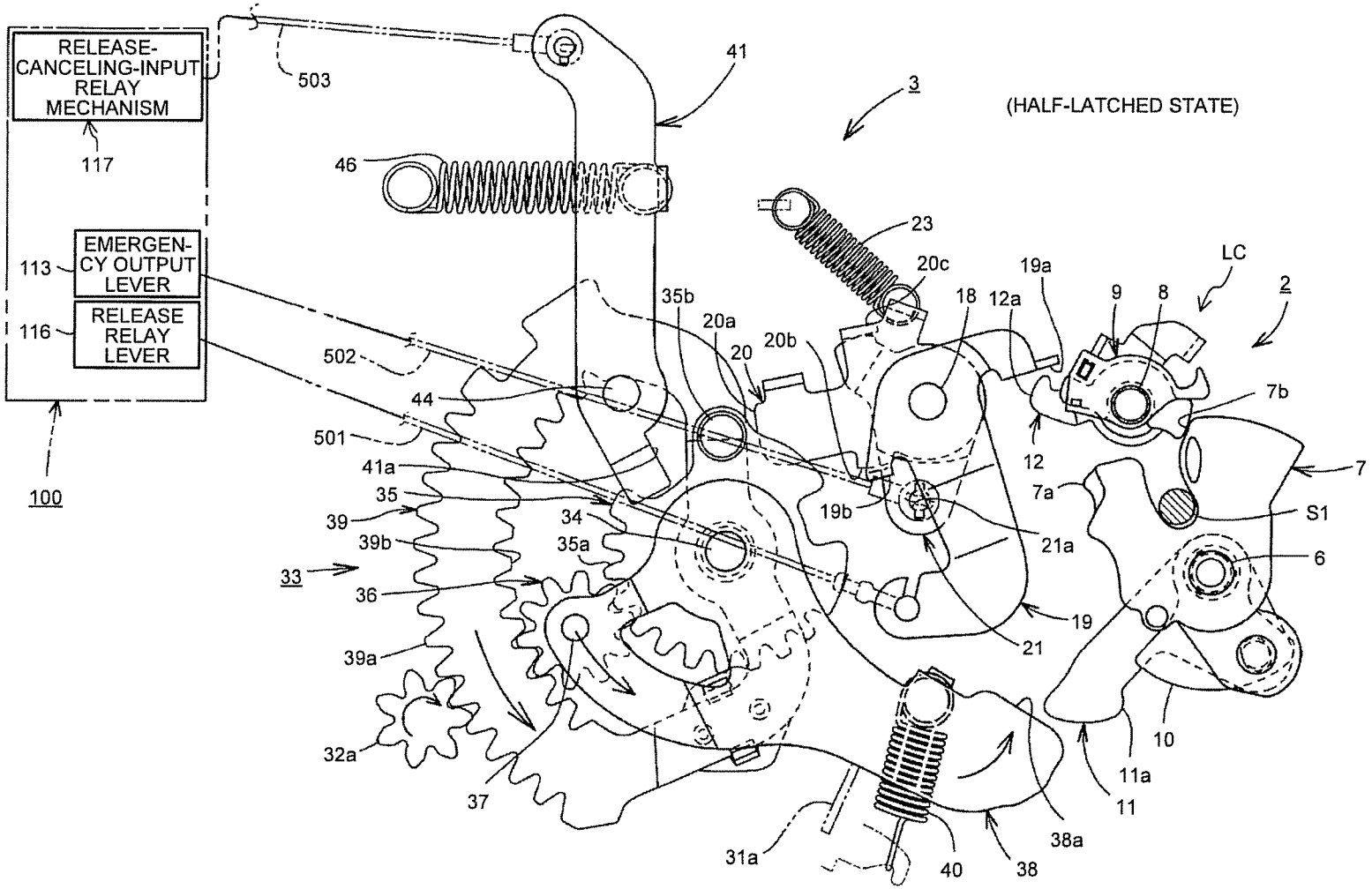
FIG. 4 is an explanatory drawing illustrating a half-latched state of the rear door latching device.

The latch 7 not engaging with the striker S1 at an unlatched position (see FIG. 3) rotates toward the closing direction (clockwise in FIG. 5) for a predetermined angle against a force of the spring (not illustrated) disposed to accommodate the latch shaft 6 to slightly engage with the striker S1 at a half-latched position (see FIG. 4). The latch 7 further rotates toward the closing direction to completely engage with the striker S1 at a full-latched position (see FIG. 6). The full-latched position of the latch 7 corresponds to the full-closed position of the door D.

A detection lever 10 and a latch lever 11, which are pivotally supported by the latch shaft 6 and integrally rotate with the latch 7, and an open lever 12, which is pivotally supported by the ratchet shaft 8 and integrally rotates with the ratchet 9, are disposed in the front side of the housing 5 (see FIG. 3).

The latch lever 11 integrally rotates with the latch 7. As illustrated in FIG. 3, when the latch 7 is at the unlatched position, an operating portion 11*a* on the distal end of the latch lever 11 is out of the motion path of a closing portion 38*a* of a closing lever 38. As illustrated in FIG. 4, when the latch 7 has rotated to the half-latched position, the operating portion 11*a* of the latch lever 11 is on the motion path of the closing portion 38*a*.

A half-latch detecting switch and a full-latch detecting switch, which are not illustrated, detect that the latch 7 is at the half-latched position and the full-latched position, respectively. These detection signals are transmitted to a control unit (ECU) C (see FIG. 1) mounted in the vehicle V and used as triggers to stop or drive the motor 32 of the closer release unit 3 and the electric open/close unit PSD.

The urging force of a spring (not illustrated) continuously urges the ratchet 9, together with the open lever 12, to the engaging direction (for example, clockwise in FIG. 4). When the latch 7 is at the unlatched position illustrated in FIG. 3, the ratchet 9 makes contact with the outer periphery of the latch 7. When the latch 7 is at the half-latched position illustrated in FIG. 4, the ratchet 9 engages with the half-latch engagement portion 7*b* of the latch 7 to be held at an engaged position. When the latch 7 is at the full-latched position illustrated in FIG. 6, the ratchet 9 engages with the full-latch engagement portion 7*a* of the latch 7 to be held at another engaged position When the ratchet 9 is at the engaged position, engaging with the full-latch engagement portion 7*a* of the latch 7, and when the outside handle OH or the inside handle IH is operated to open the door D, the ratchet 9 pivots, driven via components, toward the releasing direction (counter clockwise in FIGS. 4 and 6) to be at the releasing position illustrated in FIG. 7. The ratchet 9 disengages from the full-latch engagement portion 7*a* of the latch 7 and thereby the latch 7 pivots toward the opening direction, allowing the door D to be opened.

As illustrated in FIGS. 2 and 3, a release input lever 19, a blocking lever 20, and an emergency input lever 21 are pivotally supported by a shaft 18 extending along the width direction of the vehicle on the cover plate of the latch unit 2.

The release input lever 19 is coupled to a release relay lever 116 in the operation-relaying device 100 via a cable 501 distributed in the door D. The cable 501 is, for example, a Bowden cable, which can transmit an operational force. Cables 502, 503, 504, 506, and 507, which will be described later, are also Bowden cables. When the outside handle OH or the inside handle IH is operated to open the door D, or when the electric-powered releasing mechanism R including the motor 32 performs the releasing operation, the release input lever 19 at a standby position pivots, driven via components including the release relay lever 116, toward the releasing direction (clockwise in FIGS. 4 and 6) against the urging force of a spring 23. A releasing portion 19*a* thereby pushes down an arm portion 12*a* of the open lever 12 to pivot the ratchet 9 to the releasing position, and the door D can be opened.

The blocking lever 20 is kept at a blocking position illustrated in FIGS. 3 to 6 by the urging force of the spring 23. When the release input lever 19 pivots to the releasing position (illustrated in FIG. 7), a bent portion 19*b* abuts a bent portion 20*b* provided at the bottom portion of the blocking lever 20, and thereby the blocking lever 20 pivots counter clockwise from the blocking position by a predetermined angle to a canceling position as illustrated in FIG. 7.

A coupler 21*a* provided in the lower portion of the emergency input lever 21 is coupled to an emergency output lever 113 in the operation-relaying device 100 via the cable 502 distributed in the door D. By operating the outside handle OH or the inside handle IH to open the door D, the emergency input lever 21 forces the blocking lever 20 to pivot to the canceling position to cancel the closing operation of the closer release unit 3.

2.2 Explanation on Closer Release Unit

As illustrated in FIGS. 2 and 3, the closer release unit 3 includes a motor 32 for closer-releasing operation, a planetary gear mechanism 33 functioning as a reduction gear mechanism, and a release output lever 41. The power of the motor 32 is transmitted to the planetary gear mechanism 33 via an output gear 32*a*, and the resulting reduced power operates the release output lever 41. The motor 32, the planetary gear mechanism 33, and the release output lever 41 constitute the electric-powered releasing mechanism R which makes the ratchet 9 perform the releasing operation.

The release output lever 41 is pivotally supported by a shaft 44. The release output lever 41 is continuously urged counter clockwise by a spring 46 as illustrated in FIGS. 2 and 3 to be held at a standby position as illustrated in FIGS. 3 to 6. When the motor 32 performs the releasing drive to rotate a sun gear 35 toward the releasing direction (counter clockwise in FIGS. 3 to 6), the release output lever 41 pivots from the standby position toward the releasing direction (clockwise in FIGS. 3 to 6) by a predetermined angle in conjunction with the rotation of the sun gear 35 (hereinafter referred to as a "releasing operation").

The upper portion of the release output lever 41 is coupled, via the cable 503, to a relay lever 118 (see FIG. 15) in the release-canceling-input relay mechanism 117 (hereinafter also referred to as a "relay mechanism 117") in the operation-relaying device 100.

The planetary gear mechanism 33 includes the sun gear 35, a planetary gear 36, the closing lever 38, and a sector gear 39. The sun gear 35 is pivotally supported by a shaft 34. The sun gear 35 has a sector portion of which outer periphery is provided with external teeth 35*a* that mesh with the planetary gear 36 and a column-shaped contact portion 35*b*, projecting toward the inside of the vehicle, provided on the upper portion of a rotating face where the external teeth 35*a* are not formed. The planetary gear 36 meshes with the sun gear 35 and is allowed to rotate about its own axis and revolve. The closing lever 38 is pivotally supported by the shaft 34. The closing lever 38 pivotally supports the planetary gear 36 by a shaft 37. The sector gear 39 is pivotally supported by the shaft 34. The sector gear 39 has, on the outer periphery thereof, external teeth 39*a* that mesh with the output gear 32*a*. The sector gear 39 also has internal teeth 39*b*, on the inner periphery thereof, internal teeth 39*b* that mesh with the planetary gear 36.

In the half-latched state illustrated in FIG. 4, when the sun gear 35 slightly rotates clockwise from a neutral position, the contact portion 35*b* makes contact with a blocking portion 20*a*, thereby blocking the clockwise rotation of the sun gear 35 and allowing closing drive of the motor 32 to be transmitted to the latch 7. If the blocking lever 20 pivots to the canceling position (illustrated in FIG. 7) when the motor 32 is performing the closing drive, the blocking portion 20*a* goes out of the motion path of the contact portion 35*b*. Then, the closing drive of the motor 32 cannot be transmitted to the latch 7, thereby canceling the closing operation.

Figure 5:
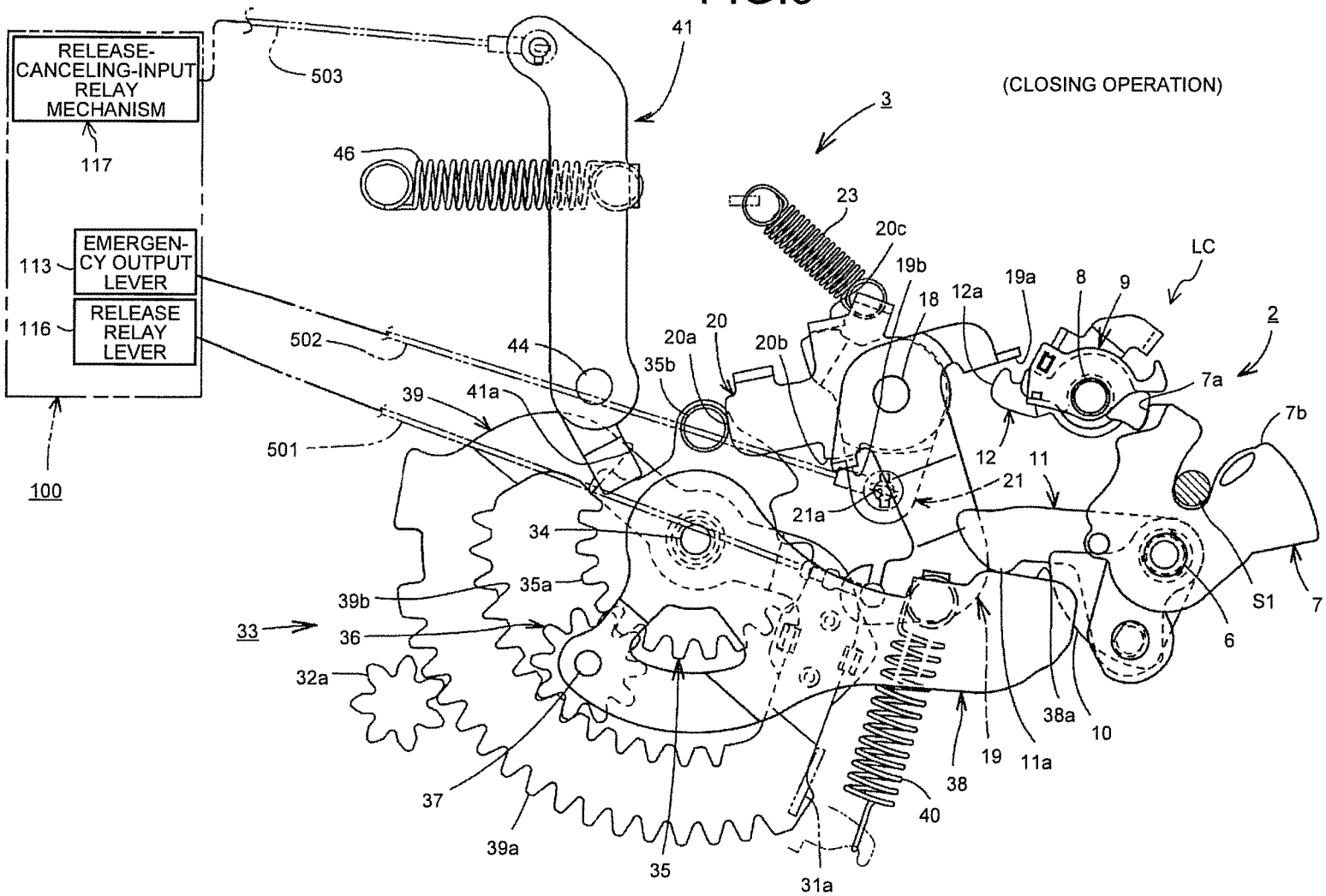
FIG. 5 is an explanatory drawing illustrating a closing operation of the rear door latching device.

When the planetary gear mechanism 33 is in a neutral state (as illustrated in FIG. 5, for example), the closing lever 38 is urged clockwise by a spring 40 and held in the standby position, making contact with the top of a stopper 31*a* (see FIG. 3). In this state, the sector gear 39 is set to a neutral position where the external teeth 39*a* face forward. The neutral position of the sector gear 39 is detected by a detecting switch 48 disposed below the sector gear 39, and the detection is transmitted to the control unit C.

2.3 Explanation on Closer Release Unit and Closing Operation

As the opened door D moves with the power of the electric open/close unit PSD and comes to the position not completely closed, the striker S1 enters a striker inlet groove 5*a* formed in the housing 5 and engages with the latch 7, and the state of the close-latch mechanism LC changes from the unlatched state illustrated in FIG. 3 to the half-latched state illustrated in FIG. 4. When the half-latch detecting switch detects that the latch 7 is in the half-latched position, the control unit C gives instruction to perform closing drive (normal rotation) to the motor 32. The motor 32 performs the closing drive to rotate the output gear 32*a* in the direction illustrated in the arrow in FIG. 4 (clockwise). In this state, the clockwise rotation of the sun gear 35 is blocked by the blocking portion 20*a* of the blocking lever 20, which is in the blocking position. Thus, the sector gear 39 rotates about the shaft 34 toward the closing direction illustrated in the arrow in FIG. 4 (counter clockwise), and in conjunction with the revolution of the planetary gear 36, the closing lever 38 pivots toward the closing direction illustrated in the arrow in FIG. 4 (counter clockwise) against the urging force of the spring 40. The closing portion 38*a* thereby moves upward to push up the operating portion 11*a* of the latch lever 11 and makes the latch 7 pivot to the full-latched position illustrated in FIG. 5. When the full-latch detecting switch detects that the latch 7 is at the full-latched position, the control unit C controls the motor 32 to temporarily stop and then perform reverse rotation.

Figure 6:
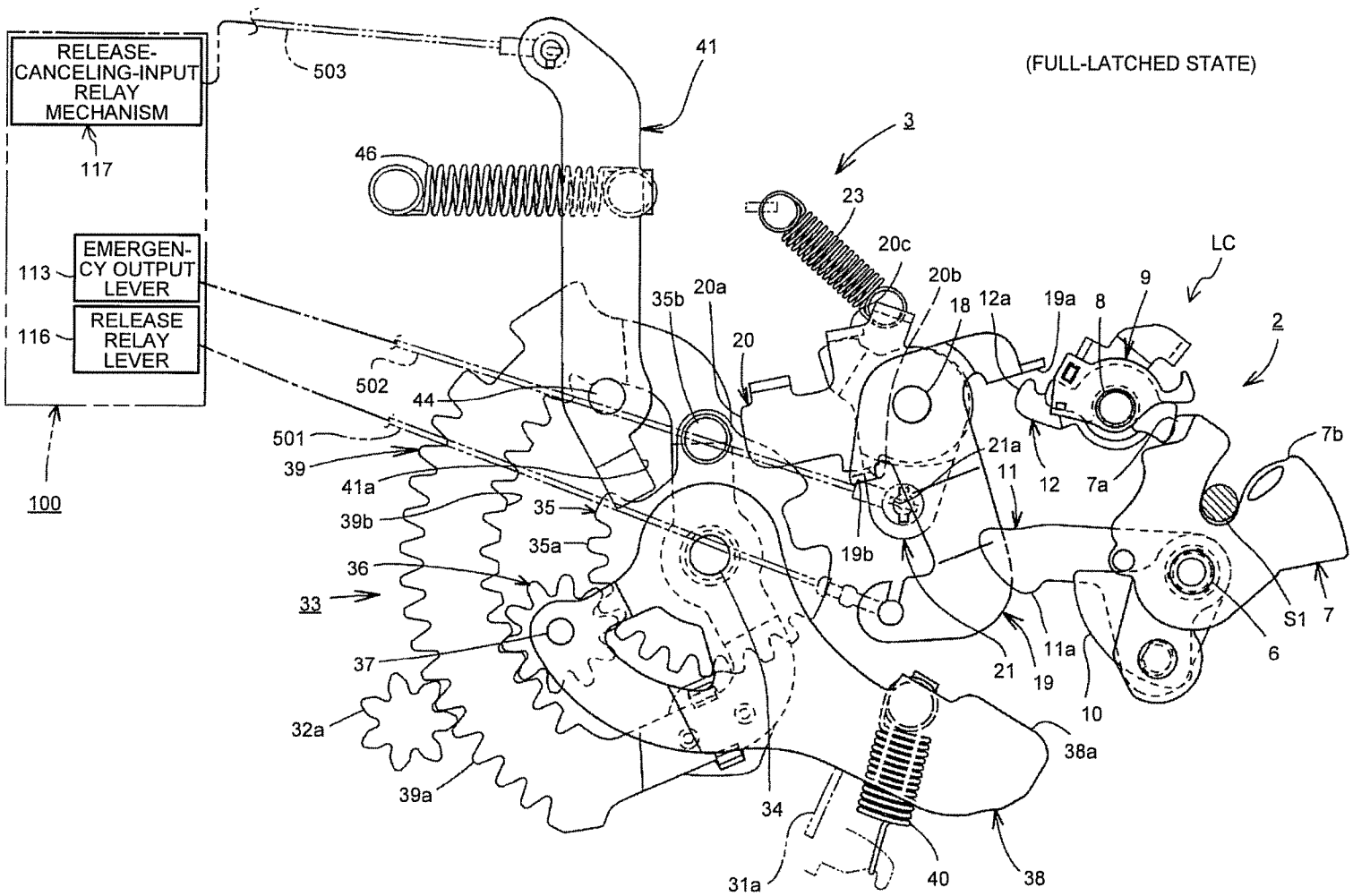
FIG. 6 is an explanatory drawing illustrating a full-latched state of the rear door latching device.
Figure 7:
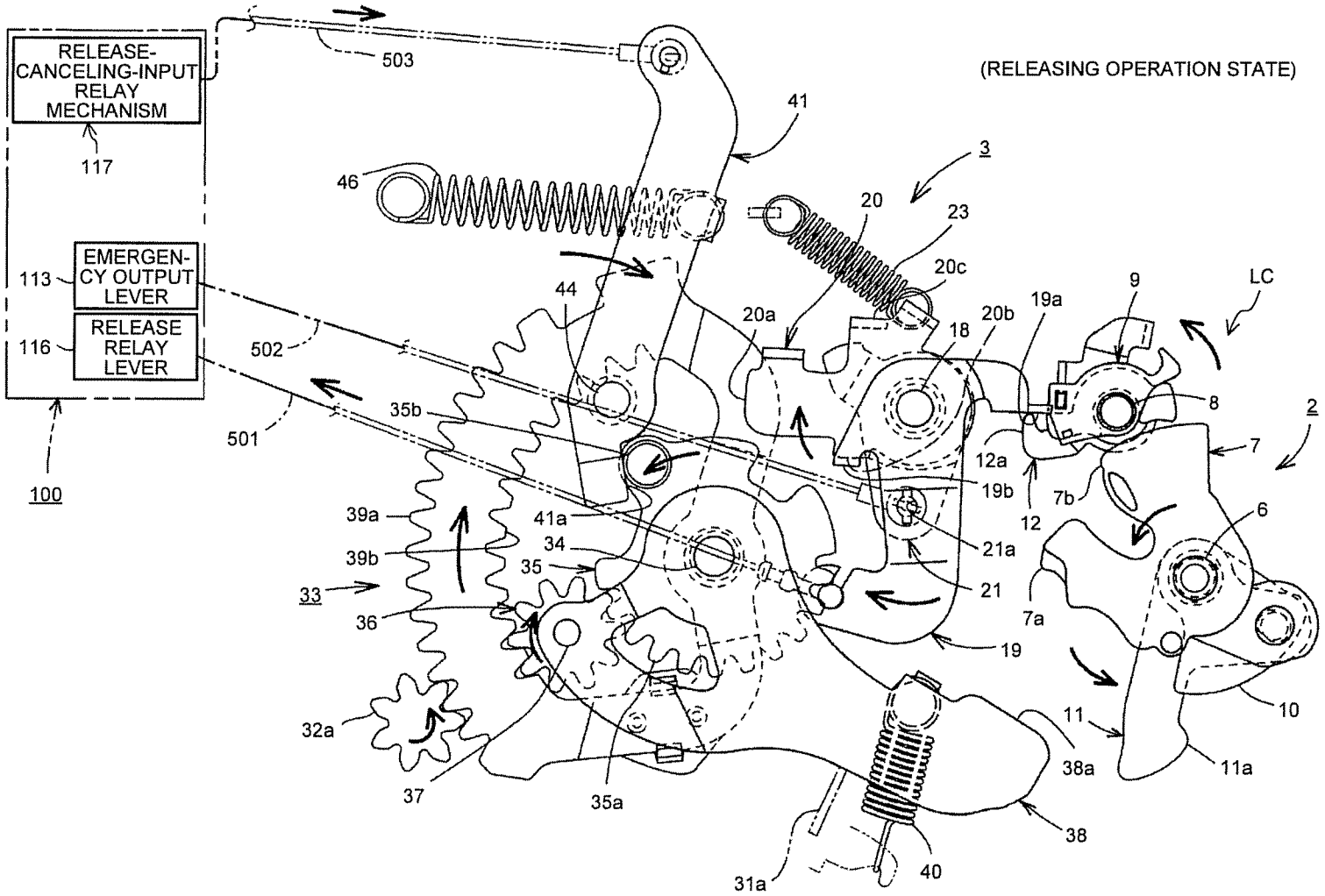
FIG. 7 is an explanatory drawing illustrating a releasing operation of the rear door latching device.

When the motor 32 operates in reverse rotation, the closing lever 38 returns to the standby position by the rotational force of the revolving planetary gear 36 and the urging force of the spring 40, as illustrated in FIG. 6. When the detecting switch 48 detects that the sector gear 39 is in the neutral position, the control unit C stops the motor 32. Now, the planetary gear mechanism 33 has returned to the state before the operation, or the neutral state, and the sequence of the closing operation is finished.

2.4 Explanation on Closer Release Unit and Releasing Operation

When the close-latch mechanism LC is in the half-latched state or the full-latched state illustrated in FIG. 4 or 6, and when the motor 32 performs the releasing drive instructed by the operation given through a manipulation switch provided in the vehicle V or a portable wireless manipulation switch, the sector gear 39 rotates about the shaft 34 toward the releasing direction (clockwise) and the planetary gear 36 rotates clockwise about its own axis without revolving. Thus, the sun gear 35 rotates toward the releasing direction (counter clockwise) by a predetermined angle, thereby pushing a releasing portion 41*a* of the release output lever 41 with the contact portion 35*b* to rotate the release output lever 41 clockwise, that is, to make the release output lever 41 perform the releasing operation (see FIG. 7).

The releasing operation of the electric-powered releasing mechanism R is transmitted to the ratchet 9 via the components, such as the operation-relaying device 100, to make the ratchet 9 pivot from the engaged position to the releasing position. In this manner, the door D can be opened. After the releasing operation, the motor 32 is controlled to operate in reverse rotation, and thereby the release output lever 41 and the components that function in conjunction with the releasing operation of the release output lever 41 return to the standby position.

3. Explanation on Whole Open-Latch Device and Open-Latch Interlocking Mechanism

Figure 9:
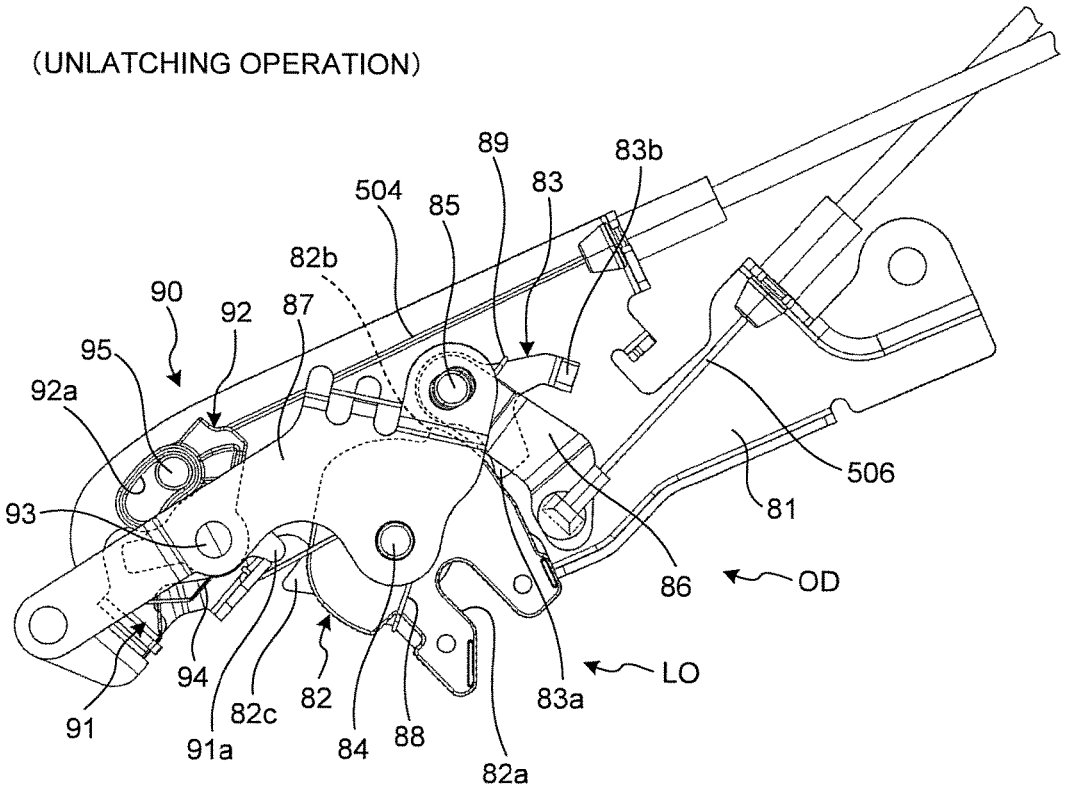
FIG. 9 is a plan view of a whole open-latch device and an open-latch interlocking mechanism.

FIG. 9 is a plan view of the whole open-latch device OD and the open-latch interlocking mechanism 90, where the door D is at the full-closed position.

3.1 Explanation on Whole Open-Latch Device

The whole open-latch device OD is a device that engages with a striker S2 (see FIGS. 10 and 11) provided on a vehicle body B to hold the door D at the full-opened position. As illustrated in FIG. 9, the whole open-latch device OD includes a metal base plate 81. The open-latch mechanism LO including a full-open latch (second latch) 82 and a ratchet (second ratchet) 83 is provided on the inner portion of the base plate 81. The whole open-latch device OD is mounted on the bottom face of the lower arm LCA (see FIGS. 13 and 14). The lower arm LCA is a metal bracket slidably supporting the door D at the door opening O.

The full-open latch 82 is pivotally supported by a latch shaft 84 extending in the up-and-down direction. When the door D is fully opened, an engagement groove 82*a* of the full-open latch 82 engages with a striker S2. The ratchet 83 is pivotally supported by a ratchet shaft 85 extending in the up-and-down direction. The ratchet 83 can engage with an engaging portion 82*b* provided on the outer periphery of the full-open latch 82. The ratchet shaft 85 pivotally supports a release input lever 86 overlapping the ratchet 83. One of ends of the latch shaft 84 and one of ends of the ratchet shaft 85 are supported on the base plate 81, and the other ends are supported on the support plate 87. A projection 82*c* is provided on the outer periphery of the full-open latch 82 at a portion closer to the open-latch interlocking mechanism 90 than the engaging portion 82*b*.

Figure 10:
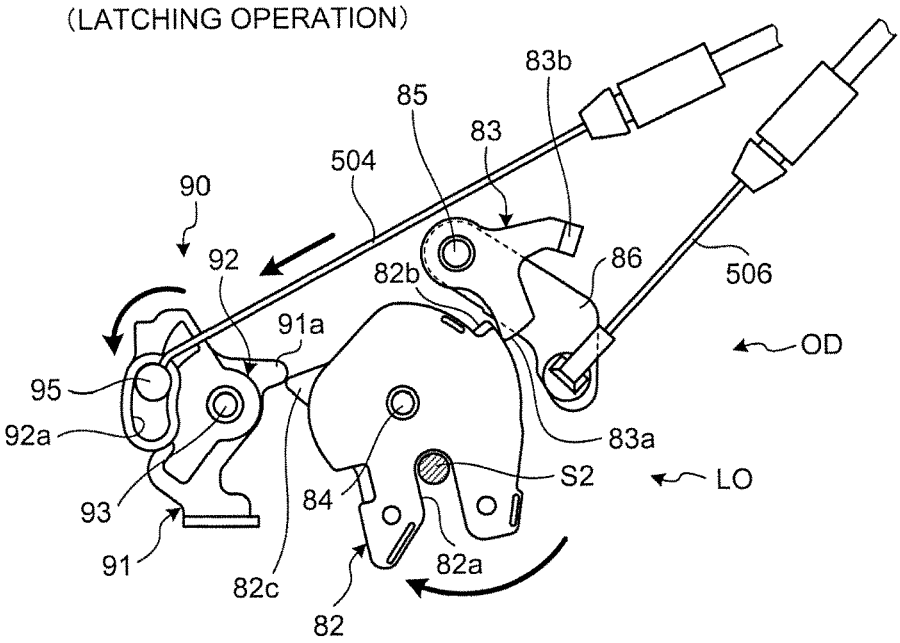
FIG. 10 is an explanatory drawing illustrating the whole open-latch device and the open-latch interlocking mechanism performing a latching operation.

The full-open latch 82 not engaging with the striker S2 at an unlatched position (see FIG. 9) pivots toward the latching direction (clockwise in FIG. 9) for a predetermined angle against an urging force of a spring 88, disposed to accommodate the latch shaft 84, to pivot to the position where the full-open latch 82 slightly engages with the striker S2 (see FIG. 10). The full-open latch 82 further pivots toward the latching direction to the latched position where the full-open latch 82 completely engages with the striker S2 (see FIG. 11). The latched position of the full-open latch 82 corresponds to the full-opened state of the door D.

The urging force of a spring 89, disposed to accommodate the ratchet shaft 85, continuously urges the ratchet 83 to the engaging direction (for example, clockwise in FIG. 9). The ratchet 83 has an approximately V-shaped protruding portion extending from the ratchet shaft 85. On two ends of the protruding portions, a hooking portion 83*a* and a bent portion 83*b* are provided. When the full-open latch 82 is at the unlatched position illustrated in FIG. 9, the hooking portion 83*a* makes contact with the outer periphery of the full-open latch 82. When the full-open latch 82 is at the latched position illustrated in FIG. 11, the hooking portion 83*a* is at the engaged position, engaging with the engaging portion 82*b* of the full-open latch 82, to block the pivoting of the full-open latch 82 toward the unlatching direction (counter clockwise in FIG. 11). When the ratchet 83 is at the engaged position, engaging with the engaging portion 82*b* of the full-open latch 82, the full-open latch 82 and the striker S2 are kept engaged with each other, keeping the door D full-opened.

The release input lever 86 is coupled to an inside lever for closing 111 (see FIG. 15) in the operation-relaying device 100 via the cable 506 distributed along the bottom face of the lower arm LCA into the door D.

Figure 12:
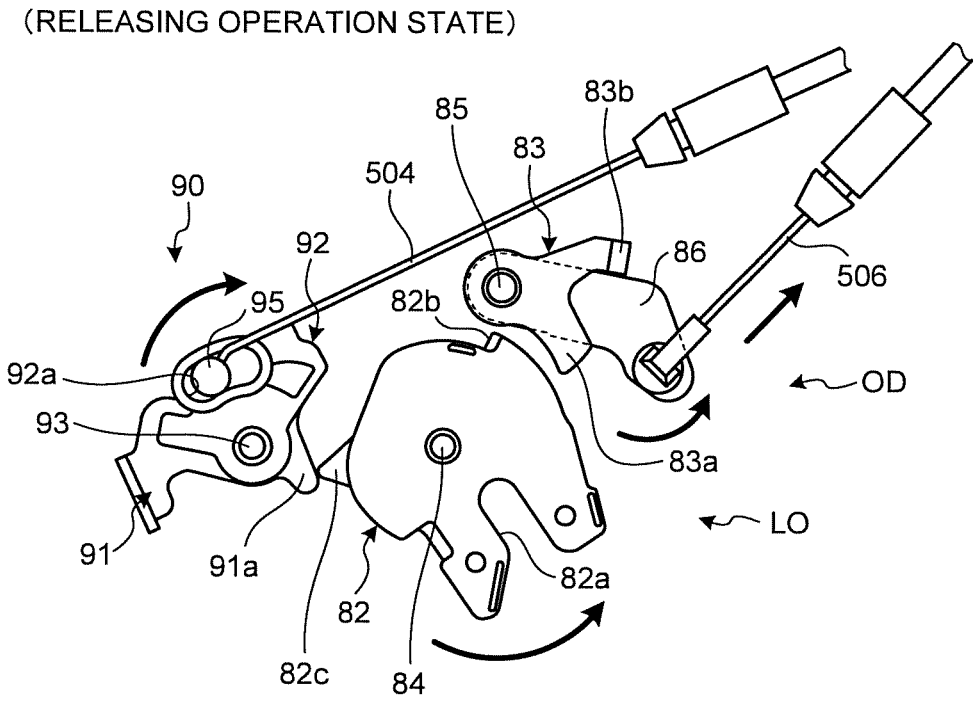
FIG. 12 is an explanatory drawing illustrating a releasing operation of the whole open-latch device and the open-latch interlocking mechanism.

In a state where the door D is full-opened and the operation-relaying device 100 is unlocked, when the inside handle IH is operated to close the door D, the inside lever for closing 111 performs the releasing operation. The releasing operation is transmitted to the release input lever 86 via the cable 506, and the release input lever 86 pivots toward the releasing direction as illustrated in FIG. 12 (counter clockwise). The side edge of the release input lever 86 then pushes the bent portion 83*b* of the ratchet 83, and the ratchet 83 pivots counter clockwise to come to the releasing position as illustrated in FIG. 12. The full-open latch 82 thus disengages from the ratchet 83, and the urging force of the spring 88 makes the full-open latch 82 to pivot, toward the unlatching direction, to come to the unlatched position.

3.2 Explanation on Open-Latch Interlocking Mechanism

As illustrated in FIG. 9, the open-latch interlocking mechanism (release canceling output mechanism) 90 is disposed, with the open-latch mechanism LO, on the inner portion of the base plate 81 of the whole open-latch device OD. The open-latch interlocking mechanism 90 performs the release-canceling operation in conjunction with the pivoting of the full-open latch 82 of the open-latch mechanism LO from the unlatched position to the latched position. The release-canceling operation is transmitted to the relay mechanism 117 via the cable 504 (see FIG. 15). On receiving the input of the release-canceling operation from the open-latch interlocking mechanism 90, the relay mechanism 117 releases the locked-in-release state to allow the door D to be closed.

The open-latch interlocking mechanism (interlocking mechanism) 90 includes a cam lever 91 and a cancel lever 92.

The cam lever 91 is pivotally supported by a shaft 93 extending in the up-and-down direction and continuously urged clockwise, when viewed as in FIG. 9, by a spring (urging member) 94 disposed to accommodate the shaft 93. The cam lever 91 includes a receiving portion 91*a* which has an arc-shaped tip and protrudes toward the full-open latch 82. The cancel lever 92 pivots integrally with the cam lever 91. The cancel lever 92 has an arc-shaped elongate hole 92*a* in which a connecting pin (connecting part) 95 provided on an end of the cable 504 is slidably inserted. As illustrated in FIG. 9, when the door D is at the closed position and the full-open latch 82 is unlatched, the connecting pin 95 is in contact with an edge of the elongate hole 92*a* close to the cable 504. The cam lever 91 and the cancel lever 92 may be provided as an integrated part.

Just before the door D opened from the full-closed position reaches the full-opened position, the full-open latch 82, at the unlatched position as illustrated in FIG. 9, makes contact with the striker S2 and pivots toward the latching direction (clockwise), and the projection 82*c* of the full-open latch 82 pushes the receiving portion 91*a* of the cam lever 91. The cam lever 91 and the cancel lever 92 pivot toward the canceling direction (counter clockwise) as illustrated in FIG. 10 by a predetermined angle (hereinafter referred to as a "release-canceling operation"), and the connecting pin 95 moves, pushed by the edge of the elongate hole 92*a*. The movement of the connecting pin 95 transmits the release-canceling operation to the disconnecting lever 120 of the relay mechanism 117 (see FIG. 15) via the cable 504. In this manner, the state of the relay mechanism 117 changes from the connected state to the disconnected state as will be described later, and thus the transmission path of releasing operation is disconnected, where the transmission path of releasing operation is provided to transmit the releasing operation of the electric-powered releasing mechanism R to the ratchet 9 of the close-latch mechanism LC.

The transmission path of releasing operation according to the embodiment runs through the release output lever 41, the cable 503, the relay mechanism 117, a connecting rod 128 (see FIG. 15), a lever mechanism 103 (release relay lever 116) in the operation-relaying device 100, the cable 501, the release input lever 19, and the ratchet 9. The switching between connection and disconnection is made in the relay mechanism 117.

When the full-open latch 82 further pivots from the position illustrated in FIG. 10 toward the latching direction (clockwise), the projection 82*c* slides over the receiving portion 91*a*. Then, the cam lever 91 and the cancel lever 92 return to their initial positions by the urging force of the spring 94 as illustrated in FIG. 11, and correspondingly, the cable 504 returns to the initial position, and the full-open latch 82 engages with the ratchet 83 to be in the latched position.

Figure 11:
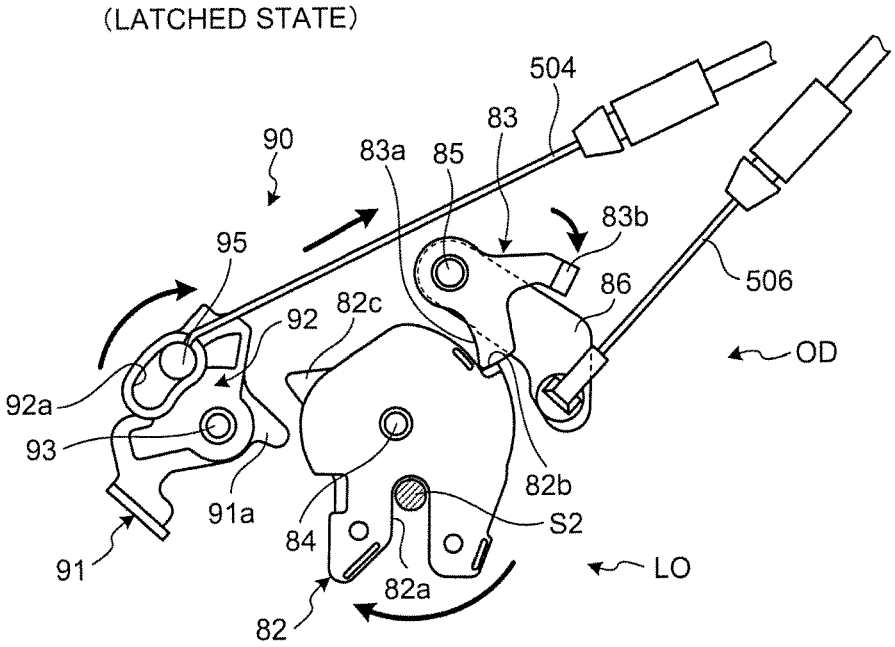
FIG. 11 is an explanatory drawing illustrating a latched state of the whole open-latch device and the open-latch interlocking mechanism.

When the door D is full-opened, and when the inside handle IH is operated to close the door D, the release input lever 86 pivots toward the releasing direction (counter clockwise), via the inside lever for closing 111 and the cable 506, from the state illustrated in FIG. 11 to the state illustrated in FIG. 12. The ratchet 83 then pivots to the releasing position, and the urging force of the spring 88 makes the full-open latch 82 pivot toward the unlatching direction.

When the full-open latch 82 pivots toward the unlatching direction, the projection 82*c* of the full-open latch 82 pushes the receiving portion 91*a* of the cam lever 91, and the cam lever 91 and the cancel lever 92 pivot clockwise by a predetermined angle as illustrated in FIG. 12. In this operation, the elongate hole 92*a* of the cancel lever 92 applies no force to the connecting pin 95, allowing the connecting pin 95 to stay where it is. Thus, no force pulling the cable 504 is generated.

As described above, the open-latch interlocking mechanism 90 generates the release-canceling operation through the operation of the full-open latch 82 made when opening the door D. The release-canceling operation is transmitted to the relay mechanism 117 via the cable 504. Meanwhile, when closing the door D, the release-canceling operation is not generated through the operation of the full-open latch 82, so that no motion is transmitted to the relay mechanism 117.

Figure 13:
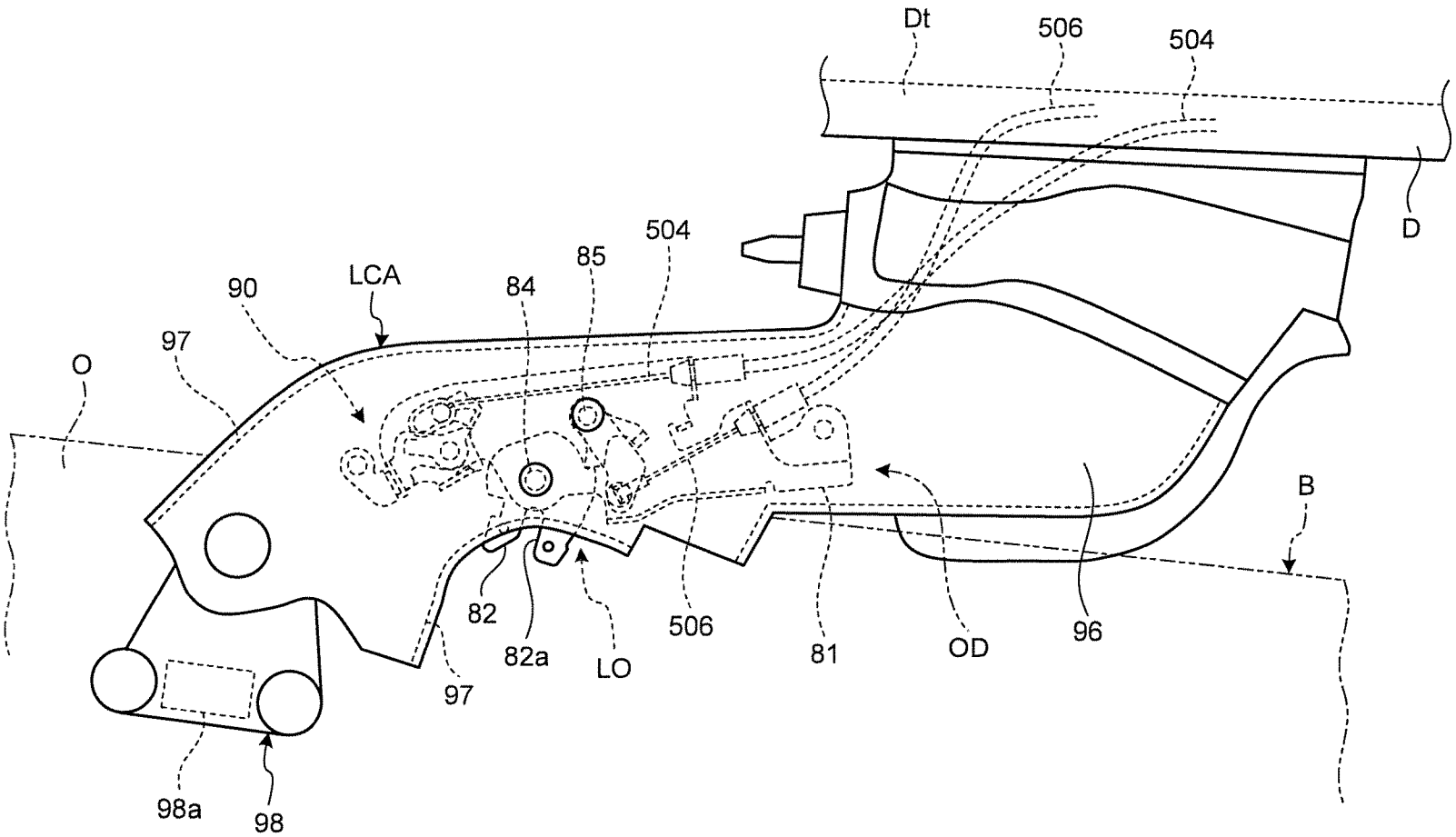
FIG. 13 is a plan view of a lower arm.
Figure 14:
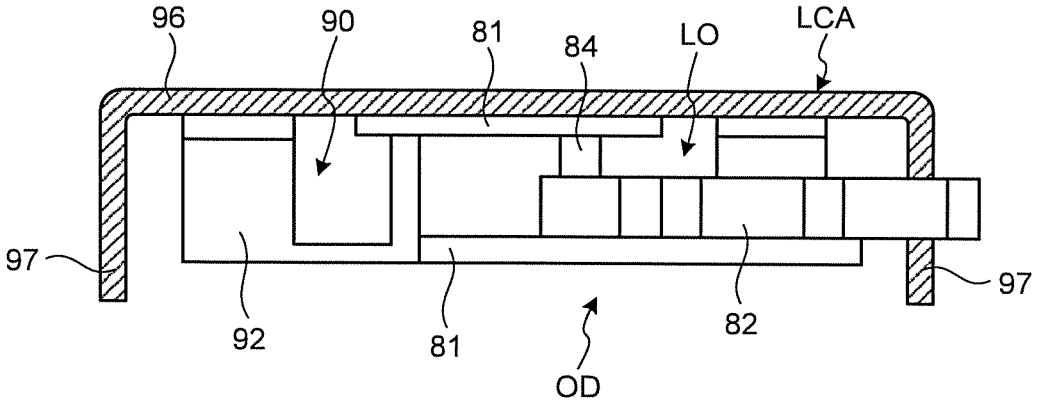
FIG. 14 is a sectional view of the lower arm.

As illustrated in FIGS. 13 and 14, the lower arm LCA includes a plate 96 disposed along horizontal direction and flanges 97, 97 protruding downward from both edges of horizontal plate 96. The whole open-latch device OD and the open-latch interlocking mechanism 90 are mounted on the bottom face (back face) of the plate 96 between flanges 97, 97.

As illustrated in FIG. 13, a slide mechanism 98 including a roller 98*a* that slides against the bottom face of the door opening O of the vehicle body B is swingably provided on an end of the lower arm LCA. The other end of the lower arm LCA is fixed to the door D. The cables 504 and 506 coming out from the open-latch interlocking mechanism 90 and the whole open-latch device OD mounted on the bottom face of the plate 96 are guided along the bottom face of the plate 96 to the door D. The cable 504 and the cable 506 are distributed into a door trim Dt to be coupled to the relay mechanism 117 and the operation-relaying device 100, respectively.

The open-latch interlocking mechanism 90 generating the release-canceling operation to release the locked-in-release state is mounted on the bottom face of the lower arm LCA with the whole open-latch device OD. So that the open-latch interlocking mechanism 90 can be installed in the vehicle V without compromising the installation space for disposing the components such as the rear door latching device 1 and the relay mechanism 117 which are disposed in the door D. The whole open-latch device OD and the open-latch interlocking mechanism 90 are mounted on the bottom face of the plate 96 between the flanges 97, that is, hidden behind the flanges 97. So that, damaging of the whole open-latch device OD and the open-latch interlocking mechanism 90, by a user stepping thereon when getting on or getting off the vehicle, can be prevented. The cable 504 coupling the open-latch interlocking mechanism 90 and the relay mechanism 117 is distributed along the bottom face of the lower arm LCA into the door trim Dt so as not to be exposed outside, while providing smooth operation of the open-latch interlocking mechanism 90 and the relay mechanism 117.

4. Explanation on Operation-Relaying Device

Figure 15:
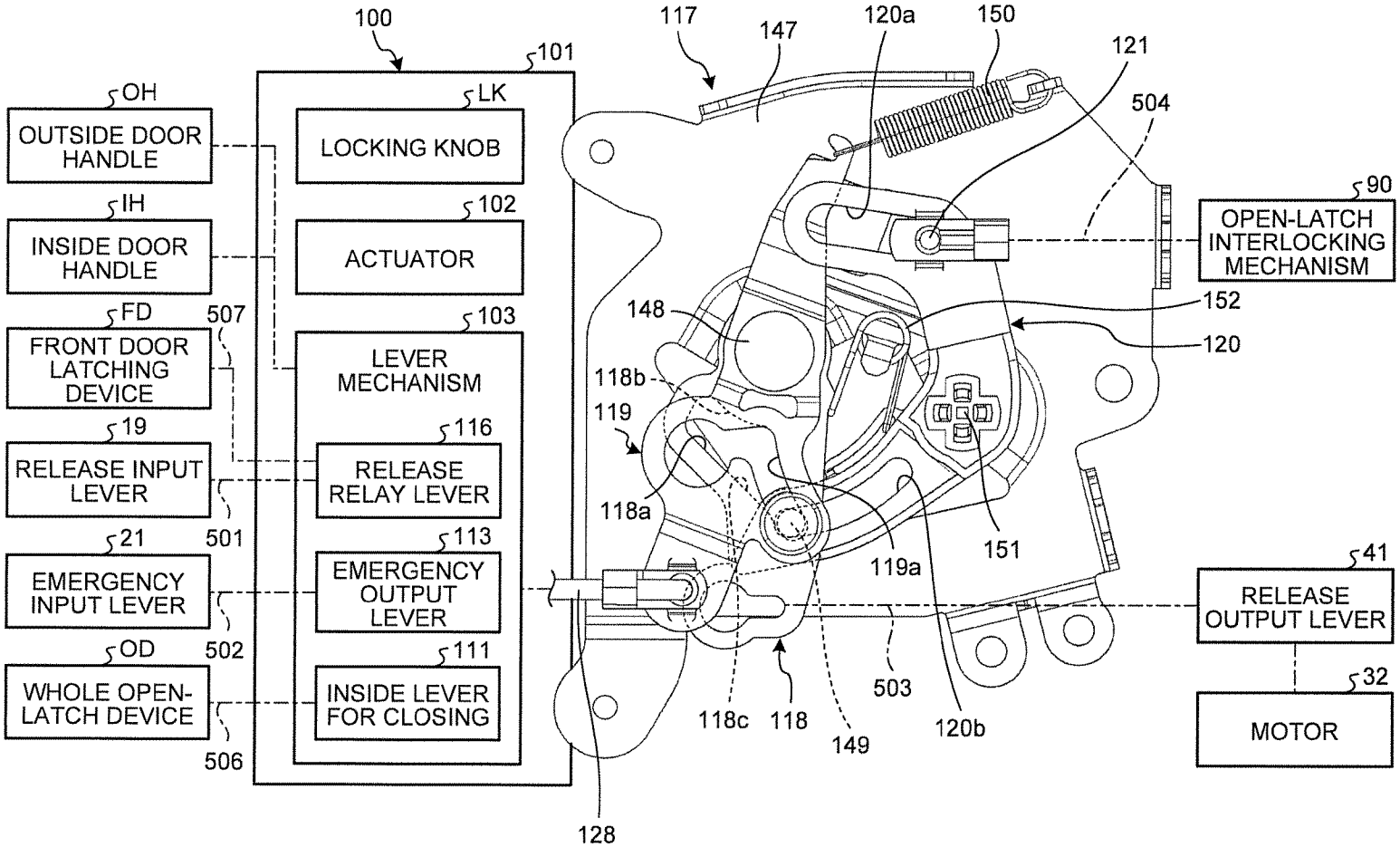
FIG. 15 is an explanatory drawing illustrating the configuration of an operation-relaying device and a release-canceling-input relay mechanism.

FIG. 15 is an explanatory drawing illustrating the configuration of the operation-relaying device 100 and the relay mechanism 117. In FIG. 15, the operation-relaying device 100 is illustrated in a block diagram and the relay mechanism 117 is illustrated with a side view looking from the inside of the vehicle.

As illustrated in FIG. 15, the operation-relaying device 100 includes a metal base plate 101 fixed to the door D. In the operation-relaying device 100, the base plate 101 supports a lock-manipulating knob LK, an actuator 102, and a lever mechanism 103.

By manually sliding the lock-manipulating knob LK to an unlocking position or a locking position from inside the vehicle, the lever mechanism 103 is selectively switched to an unlocking state or a locking state. Switching between the unlocking state and the locking state of the lever mechanism 103 can also be made by the actuator 102. The actuator 102 is operated by an unlocking operation or a locking operation given to a manipulation switch provided in a suitable place in the vehicle or a portable wireless manipulation switch.

When an outside handle OH provided on the outer side of the vehicle is operated to open the door D, each of the group of levers constituting the lever mechanism 103 operates and the control unit C drives the motor 32 in the electric-powered releasing mechanism R and operates the electric open/close unit PSD to open the door D.

The inside handle IH provided inside the vehicle is used to open or close the door D. When the inside handle IH is operated to open the door D, each of the group of levers constituting the lever mechanism 103 operates and the control unit C drives the motor 32 in the electric-powered releasing mechanism R and operates the electric open/close unit PSD to open the door D. When the inside handle IH is operated to close the door D, each of the group of levers constituting the lever mechanism 103 operates, and via the inside lever for closing 111 and the cable 506, the whole open-latch device OD performs the releasing operation to control the electric open/close unit PSD to close the door D.

The release relay lever 116 is coupled to the release input lever 19 of the rear door latching device 1 via the cable 501 and to the release lever (not illustrated) of the front door latching device FD via the cable 507. When the lever mechanism 103 is in the unlocking state, the releasing operation of the release relay lever 116 is transmitted to the release input lever 19 of the rear door latching device 1 and to the release lever of the front door latching device FD.

The emergency output lever 113 is coupled to the emergency input lever 21 of the rear door latching device 1 via the cable 502 (see FIG. 3). When the emergency output lever 113 performs the releasing operation, the blocking lever 20 moves to the canceling position as described above to stop the closing operation of the closer release unit 3.

5. Explanation on Release-Canceling-Input Relay Mechanism

Figure 16:
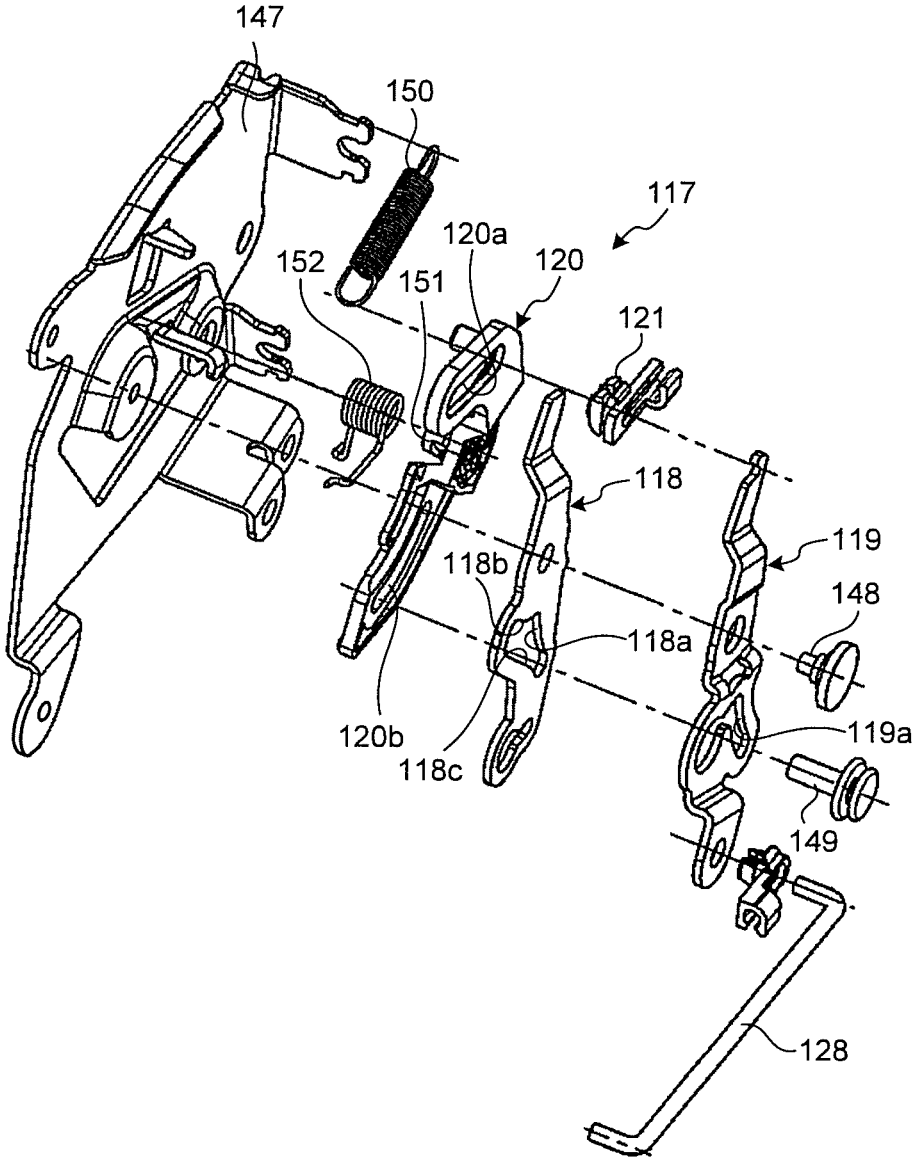
FIG. 16 is an exploded perspective view of the release-canceling-input relay mechanism.

As illustrated in FIGS. 15 and 16, the relay mechanism (release-transmission mechanism) 117 includes a metal support plate 147. In the relay mechanism 117, the support plate 147 supports the relay lever 118, a transmission lever 119, and the disconnecting lever 120. In the embodiment, the relay mechanism 117 is mounted on the base plate 101 of the operation-relaying device 100 via the support plate 147. The relay mechanism 117 may be mounted on, for example, a panel of the door D, instead of being mounted on the operation-relaying device 100.

The state of the relay mechanism 117 can be switched between a connected state and a disconnected state, where the transmission of the releasing operation of the release output lever 41 generated by the releasing drive of the motor 32 to the rear door latching device 1 and the front door latching device FD can be made under the connected state, and cannot be made under the disconnected state. When an electrical trouble, such as a malfunction or stick of the motor 32, occurs when the motor 32 in the electric-powered releasing mechanism R is performing the releasing drive, causing the close-latch mechanism LC to stop in the middle of the releasing operation, the locked-in-release state occurs and the door D cannot be held. In such a situation, the relay mechanism 117 changes to the disconnected state, thereby disconnecting the transmission path of releasing operation, which is provided to transmit the releasing operation of the electric-powered releasing mechanism R to the ratchet 9, to cancel the locked-in-release state. Thus, the door D can be held.

The relay lever 118 is pivotally supported by a shaft 148 extending in the width direction of the vehicle on the support plate 147. The lower portion of the relay lever 118 is coupled to the release output lever 41 of the rear door latching device 1 via the cable 503. In conjunction with the releasing operation of the release output lever 41 generated by the releasing drive of the motor 32, the relay lever 118 pivots counter clockwise by a predetermined angle from a standby position illustrated in FIG. 15 to a releasing position illustrated in FIG. 17 (hereinafter referred to as a "releasing operation").

A control hole 118*a* having a shape changing along the up-and-down direction is provided in the lower portion of the relay lever 118. The control hole 118*a* has an approximately triangular shape. The control hole 118*a* has an approximately L-shaped edge on the side close to the disconnecting lever 120, a arcuate portion 118*b* extending from the tip (recessed portion) of the approximately L-shaped edge toward the direction opposite to the disconnecting lever 120, and an inclined portion 118*c* extending downward and gradually inclining toward the disconnecting lever 120 from the end (far end) of the arcuate portion 118*b*. A floating pin 149 slidably engages in the control hole 118*a* to move up and down along with the motion of the disconnecting lever 120.

The transmission lever 119 is pivotally supported by the same shaft as the relay lever 118, or the shaft 148, on the support plate 147. When the disconnecting lever 120 is in the connecting position illustrated in FIGS. 15 and 17, that is, when the relay mechanism 117 is in the connected state, the transmission lever 119 can operate in conjunction with the releasing operation of the relay lever 118. In conjunction with the releasing operation, the transmission lever 119 pivots, together with the relay lever 118, counter clockwise against the urging force of a spring 150 by a predetermined angle from a standby position illustrated in FIG. 15 to a releasing position illustrated in FIG. 17 (hereinafter referred to as a "releasing operation").

The bottom portion of the transmission lever 119 is coupled to the lever mechanism 103 in the operation-relaying device 100 via the connecting rod 128. On receiving the releasing operation of the transmission lever 119 transmitted via the connecting rod 128, the lever mechanism 103 performs the releasing operation, which is transmitted to the rear door latching device 1 and the front door latching device FD.

An elongate hole 119*a* having a shape changing along the up-and-down direction is provided in the lower portion of the transmission lever 119. The floating pin 149 slidably engages in the elongate hole 119*a*.

The disconnecting lever 120 is pivotally supported by a shaft 151 extending in the width direction of the vehicle on the support plate 147 and has an approximately U-shape. The top portion of the disconnecting lever 120 is coupled to the cancel lever 92 of the open-latch interlocking mechanism 90 via the cable 504. When the cancel lever 92 of the open-latch interlocking mechanism 90 performs the release-canceling operation to pivot toward the canceling direction as described above, the disconnecting lever 120 can pivot in conjunction with the release-canceling operation. In conjunction with the release-canceling operation, the disconnecting lever 120 pivots clockwise against the urging force of the spring 152 by a predetermined angle from the connecting position illustrated in FIG. 15 to the disconnecting position illustrated in FIG. 18.

An elongate hole 120*a*, in which a connecting pin 121 provided on the other end of the cable 504 is movably inserted, is formed in the top portion of the disconnecting lever 120. In the connecting position illustrated in FIG. 15 and in the disconnecting position illustrated in FIG. 18, the connecting pin 121 is in contact with an edge of the elongate hole 120*a* close to the cable 504. As described above, when the full-open latch 82 of the whole open-latch device OD pivots as the door D closes, the open-latch interlocking mechanism 90 performs no release-canceling operation because of the function of the elongate hole 92*a* of the cancel lever 92. In the embodiment, the connecting pin 121 that connects the cable 504 and the relay mechanism 117 to transmit the release-canceling operation is also configured to move within the elongate hole 120*a*, so that the motion of the full-open latch 82 toward the unlatching direction will surely not generate the motion of the disconnecting lever 120. Either of the ends of the cable 504 is movable. Either of the elongate holes 92*a* or 120*a* may be a circular hole that disallows the movement of the connecting pin 95 or 121.

An arc-shaped elongate hole 120*b* is formed in the bottom portion of the disconnecting lever 120. The floating pin 149 slidably engages in the elongate hole 120*b*.

The floating pin 149 is slidably inserted through the control hole 118*a* of the relay lever 118, the elongate hole 119*a* of the transmission lever 119, and the elongate hole 120*b* of the disconnecting lever 120.

When the disconnecting lever 120 is in the connecting position illustrated in FIG. 15, the floating pin 149 is at the bottom edge of the control hole 118*a* of the relay lever 118 and connects the transmission path of releasing operation between the relay lever 118 and the transmission lever 119, so that the transmission lever 119 can perform the releasing operation together with the relay lever 118.

Figure 18:
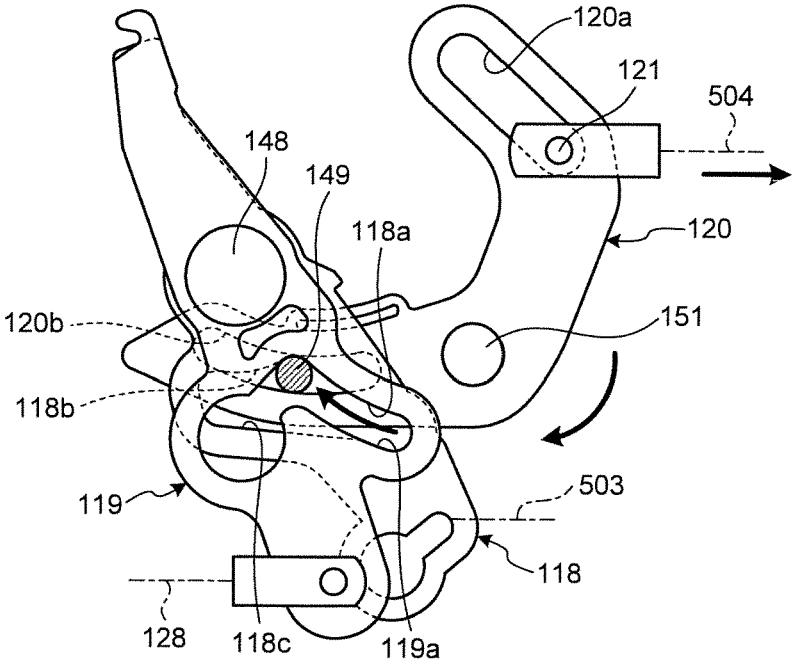
FIG. 18 is an explanatory drawing illustrating the release-canceling-input relay mechanism in a disconnected state during the releasing operation.
Figure 19:
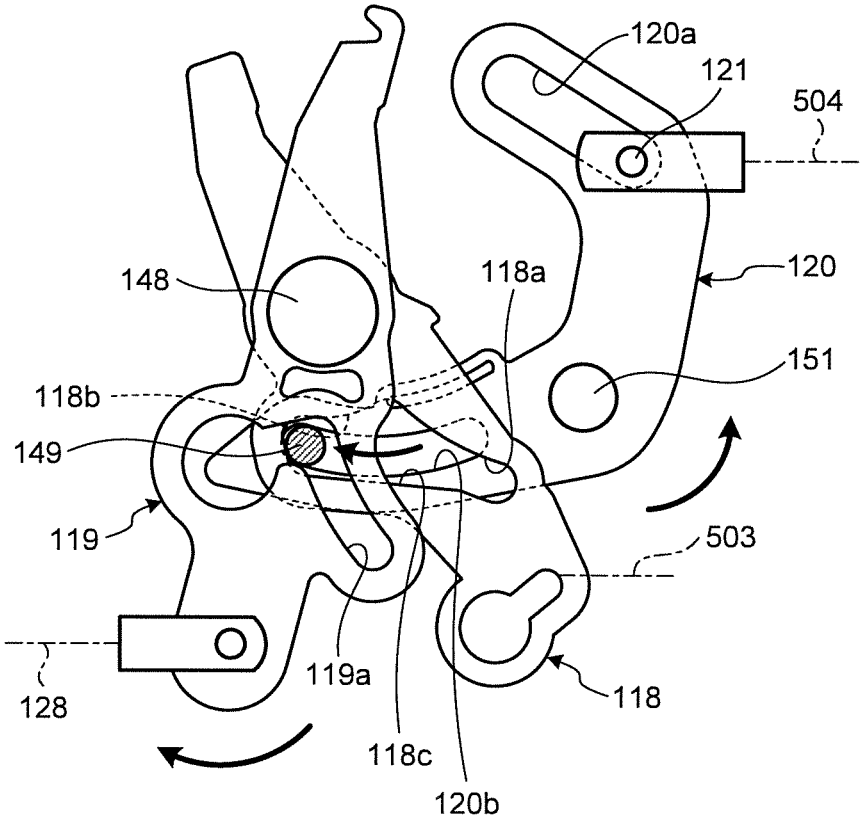
FIG. 19 is an explanatory drawing illustrating a release-canceling operation of the open-latch interlocking mechanism transmitted to the release-canceling-input relay mechanism.

As illustrated in FIG. 18, when the relay lever 118 and the transmission lever 119 are in the position of the releasing operation, and when the disconnecting lever 120 pivots from the connecting position to the disconnecting position, the floating pin 149 travels upward in the control hole 118*a* along the elongate hole 119*a*. The floating pin 149 moves to an initial point (the tip of the L-shaped edge of the control hole 118*a*) of the arcuate portion 118*b* of the control hole 118*a*, as illustrated in FIG. 18. From this location of the floating pin 149, the floating pin 149 can move within the control hole 118*a* along the arcuate portion 118*b* and along the elongate hole 120*b* of the disconnecting lever 120, but cannot move within the elongate hole 119*a* of the transmission lever 119. Thus, the transmission of operation between the relay lever 118 and the transmission lever 119 is canceled, disconnecting the transmission path of releasing operation. Now, as illustrated in FIG. 19, though the relay lever 118 is kept in the position of releasing operation, the transmission lever 119 and the lever mechanism 103 coupled to the transmission lever 119 via the connecting rod 128 can return to the standby position.

6. Explanation on Opening-and-Closing Device for Vehicle Door

Now, an opening-and-closing device for vehicle door DO according to the embodiment will be described.

6.1 Releasing Operation by Handle when Door is Full-Closed

When the door D is in the full-closed position and the operation-relaying device 100 is in the unlocking state, and when the outside handle OH or the inside handle IH is operated to open the door D, the opening operation is transmitted to the lever mechanism 103 in the operation-relaying device 100 (see FIG. 15). On receiving the operation, the release relay lever 116 performs the releasing operation via the group of levers of the lever mechanism 103, and the releasing operation is transmitted to the rear door latching device 1 and the front door latching device FD via the cables 501 and 507.

In the rear door latching device 1, the release input lever 19 at the standby position illustrated in FIG. 6 performs the releasing operation as illustrated in FIG. 7. The ratchet 9 pivots to the releasing position to disengage from the latch 7, in other words, the close-latch mechanism LC performs the releasing operation. At the same time, the front door latching device FD performs the releasing operation to allow the door D to be opened.

6.2 Releasing Operation by Handle when Door is Full-Opened

When the door D is in the full-opened position and the operation-relaying device 100 is in the unlocking state, and when the inside handle IH is operated to close the door D, the closing operation is transmitted to the lever mechanism 103 in the operation-relaying device 100 (see FIG. 15). On receiving the operation, the inside lever for closing 111 performs the releasing operation via the group of levers of the lever mechanism 103, and the releasing operation is transmitted to the whole open-latch device OD via the cable 506.

In the whole open-latch device OD, the release input lever 86 performs the releasing operation, that is, pivots from the latched position illustrated in FIG. 11 to the position illustrated in FIG. 12. The ratchet 83 thereby pivots to the releasing position to disengage from the full-open latch 82, in other words, the open-latch mechanism LO performs the releasing operation to allow the door D to be opened.

6.3 Releasing Operation of Electric-Powered Releasing Mechanism

When the door D is in the full-closed position and the close-latch mechanism LC is in the full-latched state, and when a manipulation switch provided inside the vehicle or a wireless manipulation switch is operated to open the door D, the motor 32 included in the electric-powered releasing mechanism R performs the releasing drive. The sector gear 39 at the position illustrated in FIG. 6 then pivots toward the releasing direction (clockwise) as illustrated in FIG. 7. In conjunction with the rotation of the planetary gear 36 about its axis, the sun gear 35 in the neutral position pivots toward the releasing direction by a predetermined angle.

As illustrated in FIG. 7, the contact portion 35*b* of the sun gear 35 pivoting toward the releasing direction pushes the releasing portion 41*a* of the release output lever 41. The release output lever 41 at the standby position thereby performs the releasing operation against the urging force of the spring 46. The releasing operation is transmitted, via the cable 503, to the relay lever 118 of the relay mechanism 117 in the connected state.

Figure 17:
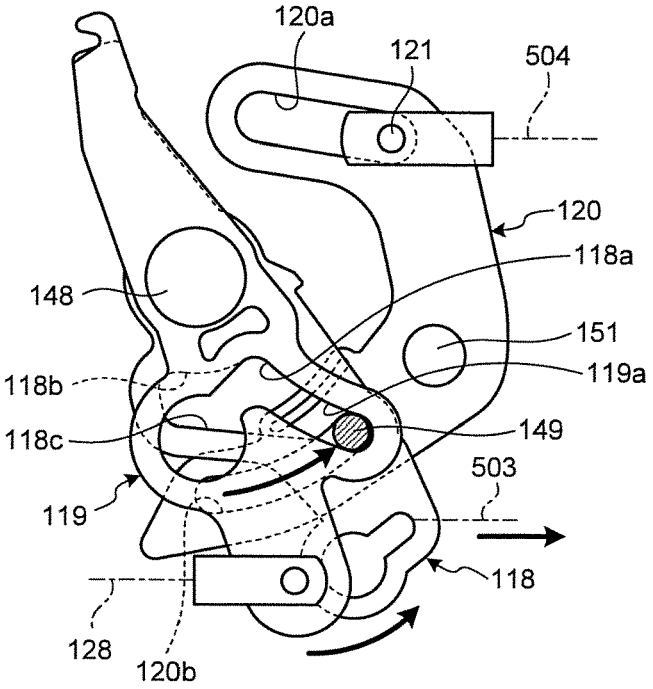
FIG. 17 is an explanatory drawing illustrating a releasing operation of the release-canceling-input relay mechanism in a connected state.

When the releasing operation of the release output lever 41 is transmitted, the relay lever 118 at the standby position illustrated in FIG. 15 performs the releasing operation as illustrated in FIG. 17. When the relay lever 118 performs the releasing operation, the transmission lever 119 coupled to the relay lever 118 with the floating pin 149 also performs the releasing operation. The releasing operation is transmitted to the lever mechanism 103 in the operation-relaying device 100 via the connecting rod 128, and the release relay lever 116 thereby performs the releasing operation.

The releasing operation of the release relay lever 116 is transmitted to the rear door latching device 1 and the front door latching device FD via the cables 501 and 507. In the rear door latching device 1, the release input lever 19 at the standby position illustrated in FIG. 6 performs the releasing operation as illustrated in FIG. 7. The ratchet 9 thereby pivots to the releasing position to disengage from the latch 7, allowing the close-latch mechanism LC to disengage from the striker S1. At the same time, the front door latching device FD performs the releasing operation to allow the door D to be opened.

As illustrated in FIG. 3, the sector gear 39 and the sun gear 35 reversely rotate to return to the neutral position, and the release output lever 41 returns to the standby position after the releasing operation. The electric-powered releasing mechanism R then returns to the standby state after the releasing operation, and other components return to each standby position after the releasing operation.

6.4 Release-Canceling Operation to Cancel Locked-in-Release State

During the operation of opening the door D from the full-closed position, the motor 32 performs the releasing drive to make the release output lever 41 perform the releasing operation, and then the motor 32 runs in reverse rotation, if there is no malfunction, to drive the components return to each neutral position or standby position. Then, when the door D is closed, the full-latch engagement portion 7*a* or the half-latch engagement portion 7*b* of the latch 7 can engage with the ratchet 9.

However, when a malfunction occurs when the ratchet 9 has pivoted, by the releasing drive of the motor 32, to the releasing position as illustrated in FIG. 7, the motor 32 might not be able to run in reverse rotation. In such a case, the release output lever 41 stops in the middle of the releasing operation and the ratchet 9 stops at the releasing position, being unable to return to the engaged position with the latch 7. This is the locked-in-release state. Under the locked-in-release state, the ratchet 9 stays in the releasing position and cannot return to the engaged position with the latch 7, so that the door D cannot be held in the closed position. Such malfunction is detected, for example, by continuously receiving detection signals for a certain period of time or more from the detecting switch that detects the ratchet 9 being in the releasing position, or when nothing is detected by the detecting switch 48 that detects the sector gear 39 being in the neutral position.

The opening-and-closing device DO according to the embodiment includes the relay mechanism 117 and the open-latch interlocking mechanism 90 to cancel the locked-in-release state, which might occur when opening the door D, to hold the door D in the closed position.

Specifically, when the rear door latching device 1 and the relay mechanism 117 stop in the positions illustrated in FIGS. 7 and 17, respectively, during the releasing operation, in other words, when the locked-in-release state occurs, the door D can still be opened to the full-opened position. When the door D comes very close to the full-opened position, the open-latch mechanism LO of the whole open-latch device OD changes to the latched state and the open-latch interlocking mechanism 90 performs the release-canceling operation.

The release-canceling operation of the open-latch interlocking mechanism 90 is transmitted, via the pivoting of the cancel lever 92 and the cable 504, to the disconnecting lever 120 of the relay mechanism 117 in the connected state as illustrated in FIG. 17.

On receiving the release-canceling operation, the disconnecting lever 120 pivots from the connecting position to the disconnecting position as illustrated in FIG. 18. In this process, the floating pin 149 travels, pushed by the edge of the elongate hole 120*a* in the disconnecting lever 120 moving toward the disconnecting position. That is, the floating pin 149 travels upward along the control hole 118*a* in the relay lever 118 and the elongate hole 119*a* in the transmission lever 119 and comes to the initial point of the arcuate portion 118*b* of the control hole 118*a* (see FIG. 18). Now, during the pivoting of the transmission lever 119 to the standby position, the floating pin 149 is restricted in the elongate hole 119*a* but can move within the control hole 118*a* along the arcuate portion 118*b* and along the elongate hole 120*b*. Thus, the transmission path between the relay lever 118 and the transmission lever 119, that is, the transmission path of releasing operation for transmitting the releasing operation of the electric-powered releasing mechanism R to the ratchet 9 is disconnected. As a result, with the release output lever 41 staying in the position of the releasing operation, the transmission lever 119 returns to the standby position by the urging force of the spring 150 while the relay lever 118 stays in the position of the releasing operation as illustrated in FIG. 19. In a normal procedure without malfunction, the floating pin 149 at the position illustrated in FIG. 18 returns to the position illustrated in FIG. 17 along with the pivoting of the disconnecting lever 120.

Figure 8:
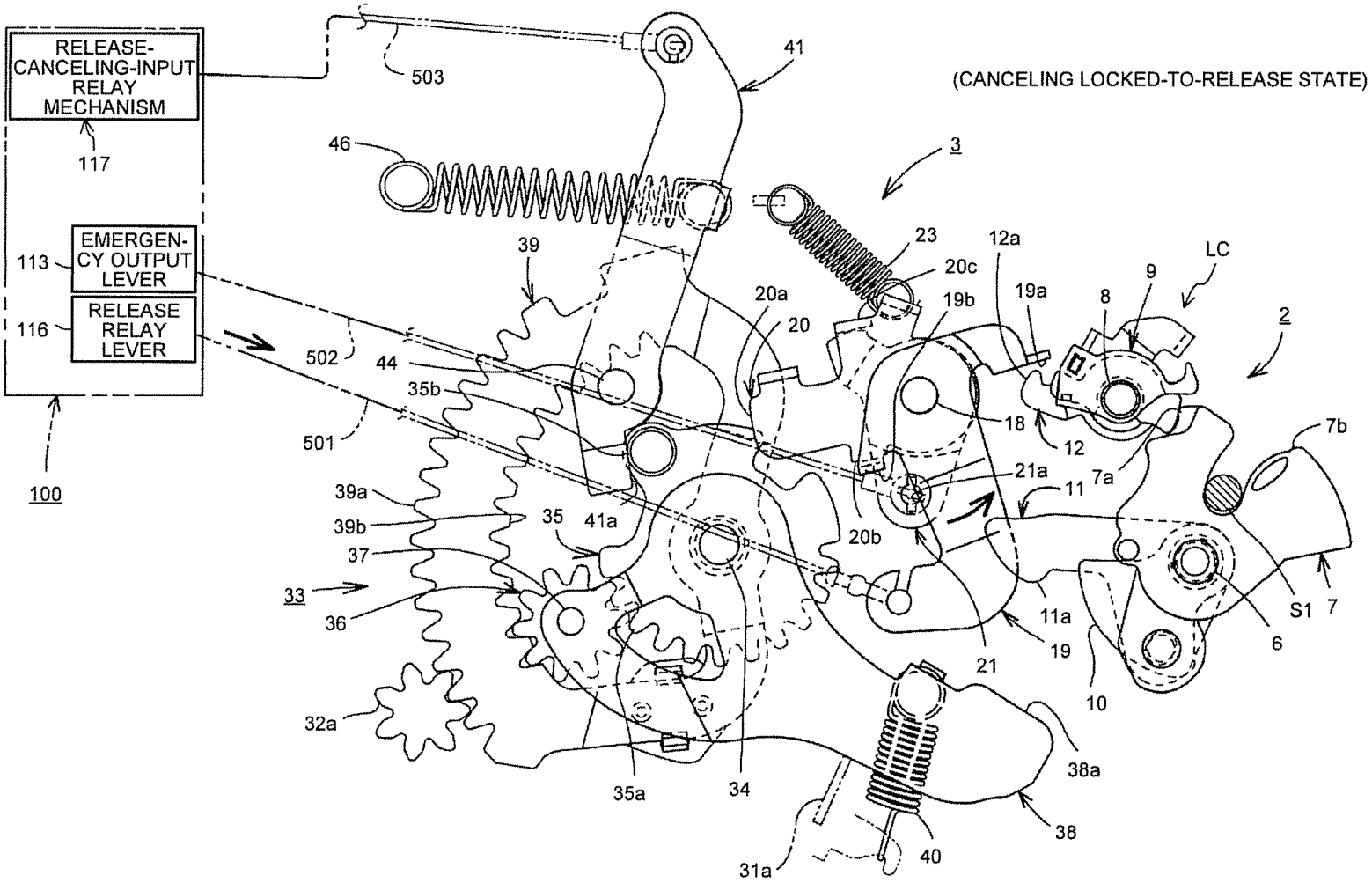
FIG. 8 is an explanatory drawing illustrating the rear door latching device after canceling the locked-in-release state.

Along with the transmission lever 119 pivoting to return to the standby position as illustrated in FIG. 19, the connecting rod 128 returns to the standby position. The release relay lever 116 included in the lever mechanism 103 in the operation-relaying device 100 thereby returns to the standby position, and also the release input lever 19 returns to the standby position as illustrated in FIG. 8. As a result, the ratchet 9 can return to the position, while the release output lever 41 being held in the position of releasing operation as illustrated in FIG. 8. Thus, when the door D is closed from the full-opened position, the latch 7 engages with the striker S1 and the ratchet 9 engages with the latch 7, thereby holding the door D in the closed position.

When the problem that caused the locked-in-release state is solved, the release output lever 41 that has stopped in the middle of the releasing operation returns to the standby position, and in conjunction with the motion of the release output lever 41, the relay lever 118 at the releasing position illustrated in FIG. 19 returns to the standby position. Accordingly, the control hole 118*a* in the relay lever 118 and the elongate hole 119*a* in the transmission lever 119 return to the position illustrated in FIG. 15. In conjunction with the disconnecting lever 120 returning to the connecting position by the urging force of the spring 152, the floating pin 149 at the far end of the arcuate portion 118*b* of the control hole 118*a* slides against the inclined portion 118*c* of the control hole 118*a* to return to the position illustrated in FIG. 15. As a result, the relay mechanism 117 returns to the connected state illustrated in FIG. 15. When an aforementioned malfunction occurs, the door D fails to respond to the command given by the electric open/close unit PSD to open the door D from the full-closed state, or to close the door D from the full-opened state. Thus, a user can easily recognize the malfunction and ask for repair, while the door D being held in the closed position by the relay mechanism 117 and the open-latch interlocking mechanism 90.

When the locked-in-release state is canceled by opening the door D, the ratchet 83 of the whole open-latch device OD, the transmission lever 119 of the relay mechanism 117, the lever mechanism 103 in the operation-relaying device 100, and the group of levers of the closer release unit 3 generate noise during returning motions thereof. In contrast, during the operation of the full-open latch 82 to close the door D, the release-canceling operation is not generated because of the function of the elongate hole 92*a* in the cancel lever 92 and the elongate hole 120*a* in the disconnecting lever 120, so that no noise is generated, avoiding a user having unnatural feeling or giving stress to a user.

When a malfunction of the motor 32 is detected when the door D is closing from the full-opened position instructed by the electric open/close unit PSD, the control unit C controls the electric open/close unit PSD to give a reverse instruction to operate the door D opening toward the full-opened position. Thus, the cancel lever 92 of the open-latch interlocking mechanism 90 can operate toward the canceling direction to change the relay mechanism 117 to the disconnected state, thereby canceling the locked-in-release state. The locked-in-release state that has occurred when closing the door D can surely be canceled, and the door D can then be closed manually to be held in the closed position.

As described above, the opening-and-closing device for vehicle door DO according to the embodiment can cancel the locked-in-release state by a normal operation of simply opening the door D. So that, if the locked-in-release state occurs, a user can hold the door D in the closed position without any special procedure.

According to the present invention, the locked-in-release state can be canceled by a normal procedure of simply opening the door. When the locked-in-release state occurs, a user can hold the door in the closed position without a special procedure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An opening-and-closing device for vehicle door comprising:

a close-latch mechanism that is provided to a door, the close-latch mechanism including a first latch configured to move from an unlatched position to a latched position and a first ratchet subject to an urging force and configured to engage with the first latch in the latched position to hold the door in a closed position;

an open-latch mechanism that is provided to the door, the open-latch mechanism including a second latch configured to move from an unlatched position to a latched position and a second ratchet subject to an urging force and configured to engage with the second latch in the latched position to hold the door in an opened position;

an electric-powered releasing mechanism including a motor configured to perform a drive by an input from a user and a release output lever configured to rotate to operate the first ratchet to a releasing position;

an open-latch interlocking mechanism that is configured to operate in conjunction with a motion of the second latch from the unlatched position to the latched position; and a relay mechanism that is configured to change a state of a transmission path of releasing operation from a connected state to a disconnected state to allow returning of the first ratchet which has stopped in the releasing position, a releasing operation of the electric-powered releasing mechanism being transmitted to the first ratchet in the connected state and not being transmitted to the first ratchet in the disconnected state, the connected state changing to the disconnected state by an operation of the open-latch interlocking mechanism, wherein the open-latch interlocking mechanism includes a cam lever configured to pivot by making contact with the second latch pivoting from the unlatched position to the latched position, a cancel lever coupled to the relay mechanism via a cable and configured to pivot integrally with the cam lever, and an urging member configured to urge the cam lever and the cancel lever, which have pivoted by making contact with the second latch, to return to initial positions, and the relay mechanism is configured to be changed from the connected state to the disconnected state with the cable pulled by pivoting of the cancel lever.

2. The opening-and-closing device for vehicle door according to claim 1, wherein the relay mechanism includes a relay lever configured to pivot by the releasing operation of the electric-powered releasing mechanism, a transmission lever configured to pivot in conjunction with the relay lever to transmit the releasing operation to the first ratchet, a disconnecting lever configured to pivot, with the cable pulled by pivoting of the cancel lever, to cancel interlock between the relay lever and the transmission lever, and a floating pin movably inserted through a hole provided in the relay lever, a hole provided in the transmission lever, and a hole provided in the disconnecting lever, and the hole in the transmission lever has an inclined portion against which the floating pin slides thereby allowing the disconnecting lever to return to an initial position, when the relay lever returns to the initial position after the interlock between the relay lever and the transmission lever is canceled by pivoting of the disconnecting lever.

* * * * *